US008438890B2

(12) United States Patent
Miyake

(10) Patent No.: US 8,438,890 B2
(45) Date of Patent: May 14, 2013

(54) CYLINDER LOCK

(75) Inventor: Mitsunori Miyake, Osaka (JP)

(73) Assignee: Goal Co., Ltd., Osaka (JP)

( * ) Notice: Subject to any disclaimer, the term of this patent is extended or adjusted under 35 U.S.C. 154(b) by 312 days.

(21) Appl. No.: 12/596,726

(22) PCT Filed: Apr. 24, 2008

(86) PCT No.: PCT/JP2008/057944
§ 371 (c)(1),
(2), (4) Date: Oct. 20, 2009

(87) PCT Pub. No.: WO2008/136356
PCT Pub. Date: Nov. 13, 2008

(65) Prior Publication Data

US 2010/0083718 A1 Apr. 8, 2010

(30) Foreign Application Priority Data

Apr. 26, 2007 (JP) ..... 2007-117801

(51) Int. Cl.
*E05B 27/06* (2006.01)

(52) U.S. Cl.
USPC ..... 70/493; 70/382; 70/383; 70/386

(58) Field of Classification Search ..... 70/337–343, 70/382–386, 493, 495, 368, 395, 491, DIG. 44, 70/DIG. 71, DIG. 75
See application file for complete search history.

(56) References Cited

U.S. PATENT DOCUMENTS 3,008,322 A * 11/1961 Stackhouse ..... 70/395
3,267,707 A * 8/1966 Adams ..... 70/419
3,380,268 A * 4/1968 Perrill ..... 70/491
4,006,615 A * 2/1977 Szova ..... 70/491
4,100,777 A * 7/1978 Fredon ..... 70/491
4,403,486 A 9/1983 Miyake (Continued)

FOREIGN PATENT DOCUMENTS

JP 56-97075 8/1981
JP 64-37867 2/1989

(Continued)

OTHER PUBLICATIONS

International Search Report dated Jun. 3, 2008 for International Application No. PCT/JP2008/057944.

(Continued)

*Primary Examiner* — Lloyd Gall
(74) *Attorney, Agent, or Firm* — Wenderoth, Lind & Ponack, L.L.P.

(57) ABSTRACT

A cylinder lock includes elongated elliptical-shaped accommodation holes for accommodating auxiliary tumblers formed on an inner cylinder, and a set/reset member which is capable of freely sliding in the inner cylinder and which is pushed by two control members each having a respective stroke length, so that the auxiliary tumblers are interposed between upper tumblers and lower tumbler and moved aside from between the upper and lower tumblers, thereby enabling changing of keys for locking and unlocking the cylinder lock. Minutely, for the setting operation, the set/reset member is pushed into by a short stroke to cause the auxiliary tumblers to be accommodated into the accommodation holes and moved along the accommodation holes and held there. For the reset operation, the set/reset member is pushed into by along stroke to move the auxiliary tumblers to the side of the upper tumbler bores of the outer cylinder.

2 Claims, 27 Drawing Sheets

U.S. PATENT DOCUMENTS

| | | | | |
|---|---|---|---|---|
| 4,747,281 | A * | 5/1988 | Monahan | 70/383 |
| 4,836,002 | A * | 6/1989 | Monahan | 70/382 |
| 5,595,080 | A * | 1/1997 | Whinton | 70/432 |
| 7,260,965 | B2 * | 8/2007 | Hung | 70/339 |
| 7,533,550 | B2 * | 5/2009 | Herdman | 70/340 |
| 7,802,455 | B2 * | 9/2010 | Herdman | 70/493 |
| 7,905,125 | B2 * | 3/2011 | Herdman | 70/383 |
| 7,958,759 | B2 * | 6/2011 | Herdman | 70/371 |
| 8,109,122 | B2 * | 2/2012 | Herdman | 70/493 |
| 2003/0084692 | A1 * | 5/2003 | Herdman | 70/338 |
| 2006/0016232 | A1 * | 1/2006 | Hung | 70/491 |
| 2006/0021406 | A1 * | 2/2006 | Herdman | 70/493 |
| 2008/0276675 | A1 * | 11/2008 | Herdman | 70/493 |
| 2010/0199733 | A1 * | 8/2010 | Herdman | 70/493 |

FOREIGN PATENT DOCUMENTS

| | | |
|---|---|---|
| JP | 4-4165 | 1/1992 |
| JP | 2005-341287 | 12/2005 |
| JP | 2006-97287 | 4/2006 |
| JP | 2006-104928 | 4/2006 |
| JP | 2006-316503 | 11/2006 |
| JP | 2007-146456 | 6/2007 |

OTHER PUBLICATIONS

International Preliminary Report on Patentability and Written Opinion of the International Searching Authority issued Nov. 19, 2009 in International (PCT) Application No. PCT/JP2008/057944.

English language Abstract of JP 2006-316503 with a publication date of Nov. 2006, previously submitted Oct. 20, 2009.

English language Abstract of JP 2006-104928 with a publication date of Apr. 2006, previously submitted Oct. 20, 2009.

English language Abstract of JP 2006-97287 with a publication date of Apr. 2006, previously submitted Oct. 20, 2009.

English language Abstract and Partial Translation of JP 2007-146456 with a publication date of Jun. 2007, previously submitted Oct. 20, 2009.

English language Abstract and Partial Translation of JP 2005-341287 with a publication date of Dec. 2005, previously submitted Oct. 20, 2009.

Partial Translation of JP 64-37867 with a publication date of Feb. 1989, previously submitted Oct. 20, 2009.

Partial Translation of JP 4-4165 with a publication date of Jan. 1992, previously submitted Oct. 20, 2009.

* cited by examiner

900B
PB1
PE1
PH1
PK1
PN1
PQ1
PT1
PW1
PC1
PF1
PI1
PL1
PO1
PR1
PV1
PX1
400
300
400A
Z1
Z2
Z3
α
A2
D2
G2
J2
M2
P2
S2
V2

CYLINDER LOCK

FIELD OF THE INVENTION

The present invention relates to a cylinder lock for a key-change system, wherein the key-change is enabled by properly moving aside an auxiliary tumbler interposed between an upper tumbler in an outer cylinder and a lower tumbler in an inner cylinder, and the previous situation is recovered when required, furthermore, a master key function is enabled to be added.

BACKGROUND OF THE INVENTION

Generally, there has been known to public a cylinder lock adopting a key-change system with such feature that with respect to a cylinder lock through which a contractor (in charge of interior works for a plurality of dwellings during construction of collective or assembly dwellings such as rental apartment houses, hotels, or the like) locks up all the dwellings, etc, by use of a construction key, the construction key is made to be no longer usable when a dweller of the dwelling is set and even once locks or unlocks the cylinder lock by using a key (a "child" key) to be exclusively used by the dweller, or with such another feature that in case that the dweller loses a child key or changes with a different dweller, when the cylinder lock is locked or unlocked by use of a forthcoming second, third, or forthcoming [[---]] fresh child key (ordinarily called "change-key"), the change key previously used is made no longer usable.

For example, a cylinder lock disclosed in the patent document 1 (Unexamined Utility Model Publication No. SHO 64-37867 official gazette) is so structured that an auxiliary tumbler is interposed between an upper tumbler in the outer cylinder and a lower tumbler in the inner cylinder, and there is formed a pocket on the outer peripheral surface of the inner cylinder at a position corresponding to the upper tumbler's chamber when the inner cylinder is turned. And for a key-change, the inner cylinder is turned by use of a fresh key to cause the auxiliary tumbler to be accommodated into the pocket on the inner cylinder, so that the cylinder lock is brought into such state that the cylinder lock is not capable of being unlocked with the previously used key and is able to be locked and unlocked by use only of the fresh key. The cylinder lock of the patent document 1 has a problem that the auxiliary tumbler once accommodated into the pocket formed on the inner cylinder is permanently accommodated in the pocket and cannot be returned to its previous situation.

The patent document 2 (Unexamined Utility Model Publication No. HEI 4-4165 official gazette) discloses a cylinder lock which has an object to return the auxiliary tumbler to its previous situation, namely, to bring the auxiliary tumbler into a reset state. The cylinder lock of the patent document 2 is characterized in that a state that the auxiliary tumbler is interposed between the upper tumbler in the outer cylinder and the lower tumbler in the inner cylinder is changed over to a key-change state by moving the auxiliary tumbler aside from between the upper tumblers and the lower tumblers, and moreover, the auxiliary tumbler in the key-change state is returned to between the upper tumblers and the lower tumblers, namely, to the previous state, i.e., the reset state. To return to the previous state means that a key having been used is changed to a fresh key, so that the lock is brought into a state that it cannot be locked/unlocked with the "old" key having been used, and thereafter, the old key having been used is again made usable.

However, the cylinder lock of the patent document 2 is so structured that the auxiliary tumbler is moved away to outside and returned from the outside by use of an exclusively usable jig. And the auxiliary tumbler itself is quite a small part. Thus, the cylinder lock has a problem that the operation of moving away and returning the auxiliary tumbler is too much troublesome and fine working for amateur users.

A novel cylinder lock which is structured as not removing the auxiliary tumbler to outside but is enabled to perform the foregoing key-change is a subject matter of patent application filed by this Applicant on Nov. 25, 2005 under patent application No. 2005-341287 (Patent Document 3).

The present invention is a further improvement of the cylinder lock of the patent document 3. Thus, first, the cylinder lock of the invention of the previous application will be explained with referring to FIGS. 20 through 27 as attached. The cylinder lock of the previous application has a reset state (in which the cylinder lock can be locked or unlocked with a plurality of change-keys) and a set state (that the cylinder lock in the reset state is newly "set" to be locked or unlocked by use of a single change-key), so that when the key is to be changed to any other change-key, the cylinder lock is first returned to the reset state with operation from the outside and then set to a state for an other change-key.

FIG. 20 is a front view of a cylinder lock of the invention of the previous application (the patent document 3), FIG. 21 a sectional view taken in the line Z1-Z1 in FIG. 20, FIG. 22 a sectional view taken in the line Z2-Z2 in FIG. 20, FIG. 23 a sectional view taken in the line Z3-Z3 in FIG. 20, FIG. 24 a sectional view taken in the lines D2-D2, and E-F in FIGS. 21, 22, FIG. 25(A) a side view of an inner cylinder 400, FIG. 25(B) a front view of the inner cylinder 400, and FIG. 25(C) a sectional view taken the line Z3-Z3 in FIG. 25(B).

FIGS. 21 through 25 each show the reset state of the cylinder lock 100 of the invention of the previous application (the patent document 3). The cylinder lock 100 comprises an outer cylinder 200 (having a plurality of upper pin chambers A1-X1 in its longitudinal direction), an inner cylinder 400 (fit into the outer cylinder 200 in such manner as being able to freely rotate and having a key way 300 and a plurality of lower pin chambers A2-X2 corresponding to the upper pin chambers A1-X1 of the outer cylinder 200), and, upper tumblers A3-X3 and lower tumblers A4-X4 each fit into respective column A-X formed by the upper pin chambers A1-X1 and lower pin chambers A2-X2. Interposed between the upper tumblers and lower tumblers is an auxiliary tumbler 700 so that when a shear line SL set on the inner peripheral surface of the outer cylinder 200 and the outer peripheral surface of the inner cylinder 400 corresponds to either a boundary line between the auxiliary tumbler 700 and the bottom of upper tumbler or a boundary line between the auxiliary tumbler 700 and the lower tumbler, the cylinder lock can be locked or unlocked by a key's operation for the inner cylinder 400 with respect to the outer cylinder 200. Such auxiliary tumblers 700 are arranged between the ten upper tumblers (E3, F3, I3, K3, L3, N3, O3, Q3, U3, W3) and the ten lower tumblers (E4, F4, I4, K4, L4, N4, O4, Q4, U4, W4) placed in the columns E, F, I, K, L, N, O, Q, U, W as shown in FIG. 22 (in the cylinder lock 100 of the invention of the previous application, Patent document 3).

The boundary line at the upper side or lower side of the ten auxiliary tumblers 700 is brought to correspond to the shear line SL. Otherwise, the auxiliary tumblers 700 are moved aside to cause the boundary line between the upper tumblers and the lower tumblers to correspond with the shear line SL, so that the cylinder lock may be locked or unlocked with a key's operation for the inner cylinder 400 with respect to the outer cylinder 200. Accordingly, a plurality of patterns of shapes of key serration to correspond to the shear line SL can be set, whereby a plural kinds of keys are made usable as adaptable keys. And by a predetermined operation from the outside, one or more of a plurality of auxiliary tumblers 700 positioned between the upper tumblers and the lower tumblers is/are moved aside, so that the cylinder lock can be set as to be locked or unlocked by use of a specific key.

The auxiliary tumblers 700 moved from between the upper and the lower tumblers are placed into accommodation pockets PE, PF, PI, PK, PL, PN, PO, PQ, PU, PW for the auxiliary tumblers 700 formed in the inner cylinder 400 as shown in FIGS. 23 and 24. The auxiliary tumblers 700 placed in the accommodation pockets are kept as they are in the state until a resetting operation from the outside is carried out. The auxiliary tumblers 700 are made of a metal material having anti-corrosion properties and formed in the shape of a ball.

The accommodation pockets (PB, PC, PE, PF, PH, PI, PK, PL, PN, PO, PQ, PR, PT, PU, PW, PX) are formed, as shown in FIGS. 23-25, with cylindrical holes (PB1, PC1, PE1, PF1, PH1, PI1, PK1, PL1, PN1, PO1, PQ1, PR1, PT1, PU1, PW1, PX1) each having a shape of genuine circularity and formed at a fixed distance and in two lines on the outer peripheral surface of the tubular shaped inner cylinder 400, and roots (PB2, PC2, PE2, PF2, PH2, PI2, PK2, PL2, PN2, PO2, PQ2, PR2, PT2, PU2, PW2, PX2) of a resetting member 900 arranged in the inner cylinder and having serrated edge.

The resetting member 900 is arranged in a manner of being able to slide in a pair of grooves 400A which extends through the cylindrical holes (PB1, PC1, PE1, PF1, PH1, PI1, PK1, PL1, PN1, PO1, PQ1, PR1, PT1, PU1, PW1, PX1) and is formed continuously longitudinally of the inner cylinder 400.

Also, the resetting member 900 has crests between the adjoining roots (PB2, PC2, PE2, PF2, PH2, PI2, PK2, PL2, PN2, PO2, PQ2, PR2, PT2, PU2, PW2, PX2) in such manner that in a normal situation, the roots are aligned with the cylindrical holes (PB1, PC1, PE1, PF1, PH1, PI1, PK1, PL1, PN1, PO1, PQ1, PR1, PT1, PU1, PW1, PX1) thanks to an urging force of a spring 900A.

Next, with referring to FIG. 26 in which a change key CK is inserted into a key way 300 (in the resetting state shown in FIG. 24), operation for setting the change key CK as an adaptable key will be explained. To be noted is that in the reset state shown in FIGS. 22 and 24, any one of all of the plural change keys CK is able to be set as an adaptable key. When one change key CK is once set as the adaptable key, the remaining change keys are not able to lock or unlock the cylinder lock without carrying out the resetting operation. Carrying out the resetting operation enables previously prepared other change keys CK to be set as the adaptable key.

(1) In the resetting state, when a specific change key CK is intended to be set as an adaptable key, at first, the change key CK is inserted into a key hole 300 of the cylinder lock 100 in the reset state as shown in FIG. 24, so that serration of the inserted change key CK pushes the lower tumblers E4 and F4 in the directions indicated by the arrows in FIG. 26, whereby providing such situation that the boundary line between the auxiliary tumbler 700 and the upper tumbler F3 corresponds to the shear line SL, and that between the auxiliary tumbler 700 and the lower tumbler E4 to the shear line SL. Accordingly, for each of a plurality of change keys CK each having different serration, the auxiliary tumblers 700 are arranged placed in the upper pin chamber A1-X1 or lower tumbler bore A2-X2 through the shear line SL in the columns A-X in which the auxiliary tumblers 700 are interposed. In the exemplified previous application's invention, the auxiliary tumblers 700 are interposed to exist in ten columns E, F, I, K, L, N, O, Q, U, and W.

(2) Next, when the change key CK in the state of being inserted into the key way 300 is turned clockwise a degrees (45°) as shown in FIG. 26, the auxiliary tumbler 700 (which has been shifted across the shear line SL to the side of the upper tumbler bore E1 with insertion of the change key CK into the key hole 300 and function of the serration and surface figuration of the change key CK) keeps the position in the upper tumbler bore E1, so that when the accommodation pocket PE is aligned with the upper tumbler bore E1, the auxiliary tumbler 700 is moved thanks to elasticity of a spring urging the upper tumbler E3 in the direction of projecting to thereby be accommodated into the accommodation pocket PE (as the state shown by two-dots chain line in FIG. 26). Meanwhile, another auxiliary tumbler 700 remaining in the lower tumbler bore F2 of the inner cylinder 400 without moving across the shear line SL rotates together with the inner cylinder 400.

FIG. 27(A) is a partially cut out sectional view of the principal part showing such state that the accommodation pockets are aligned with the upper pin chambers and the auxiliary tumblers 700 which moved across the shear line SL to the upper pin chamber are immediately before being substantially accommodated into the accommodation pockets, FIG. 27(B) a partially cut out sectional view of the principal part showing the auxiliary tumblers placed in the accommodation pockets, and FIG. 27(C) a partially cut out sectional view of the principal part showing the auxiliary tumblers being pushed up by the reset member which is pressed with a control member.

As shown in FIGS. 27(A),27(B), with the serration and surface figuration of the change key CK, the auxiliary tumblers 700 are pushed to the side of the upper pin chambers E1, N1, Q1. And the inner cylinder 400 is rotated a degrees to cause the auxiliary tumblers 700 to be accommodated into the accommodation pockets PE, PN, PQ.

As foregoing, the change key CK is inserted into the key way 300 and rotated $\alpha$ degrees clockwise. All the auxiliary tumblers 700 which pushed to the upper pin chamber side with function of the serration and surface figuration of the change key CK are placed into the corresponding accommodation pockets. Then in this state, the change key CK is turned counterclockwise a degrees and pulled out. By this, this change key CK is set as an adaptable key which is able to lock and unlock the cylinder lock.

In this "set" state, three auxiliary tumblers 700 positioned at the columns E, N, Q, as shown in FIG. 22 (a sectional view taken in the line Z2-Z2 in FIG. 20), are moved aside and accommodated into the accommodation pockets, while in the rest state, all of the auxiliary tumblers 700 (which not pushed to the upper pin chamber side by the serration and surface figuration of a change key CK to be set) remain in the columns.

(3) Next, with referring to FIG. 27(B), explanation will be made regarding operation for returning from the state that the above-mentioned change key CK was set as an adaptable key to the reset state in which any other change key CK is able to be set as an adaptable key.

By the way, as foregoing, the reset member 900 has crests between the adjoining roots (PB2, PC2, PE2, PF2, PH2, PI2, PK2, PL2, PN2, PO2, PQ2, PR2, PT2, PU2, PW2, PX2). A gentle tapered part is formed between each crest and each root (PB2, PC2, PE2, PF2, PH2, PI2, PK2, PL2, PN2, PO2, PQ2, PR2, PT2, PU2, PW2, PX2).

In the set state shown in FIG. 27(B), with the change key being inserted, as seen in FIG. 27(C), a push-out pin 911 of a control member 910 is inserted into a reset pin insertion bore 900B, the push-out pin 911 having a cross-section smaller than that of the reset pin insertion bore 900B. With that the pin 911 end continues pushing the reset member 900 against elasticity of the spring 900A, all the auxiliary tumblers 700 accommodated in the accommodation pockets PE, PN, PQ are, along the tapered parts formed on the reset member 900, pushed upward together with the upper tumblers E3, N3, Q3 against an urging force of the upper tumbler springs by means of the tapered parts of the reset member 900 through movement of the reset member 900 in the direction of its getting-inward (leftward in FIG. 27(C)) by the control member 910. And, in the state that the reset member 900 does completely get inward as seen in FIG. 27(C), the auxiliary tumblers 700 push up the upper tumblers E3, N3, Q3, by means of the crests formed between the roots PB2, - - - PX2, against the urging force of the upper tumbler spring, so that the auxiliary tumblers 700 move from the accommodation pockets PE, PN, PQ in the upper pin chambers E1, N1, Q1 to be accommodated there.

With keeping the state, the control member 910 with the change key are turned counterclockwise a degrees and then pulled out, whereby bringing about the reset state. Namely, the auxiliary tumblers 700 once placed in the accommodation pockets PE, PN, PQ return to the initial state shown in FIG. 22.

Patent Document 1: Unexamined Utility Model Publication No. SHO 64-37867 official gazette Patent Document 2: Unexamined Utility Model Publication No. HEI 4-4165 official gazette Patent Document 3: Previous Patent Application No. 2005-341287 (not yet published)

DETAILED DESCRIPTION OF THE INVENTION

Problems that the Invention is to Solve

As seen from the above, the cylinder locks of the patent documents 1 and 2 are so structured that the auxiliary tumblers to enable the key-change are removed to the outside for the purpose. And the patent document 3 provides the cylinder lock wherein the auxiliary tumblers are to be accommodated into accommodation pockets formed in an inner cylinder 400 inside the cylinder lock 100, so that resetting operation is performed by use of a reset key from the outside to realize a key-change to other change-keys CK. But, the patent document 3 has such problem that it is not able to make setting of a master key.

Figure 20:
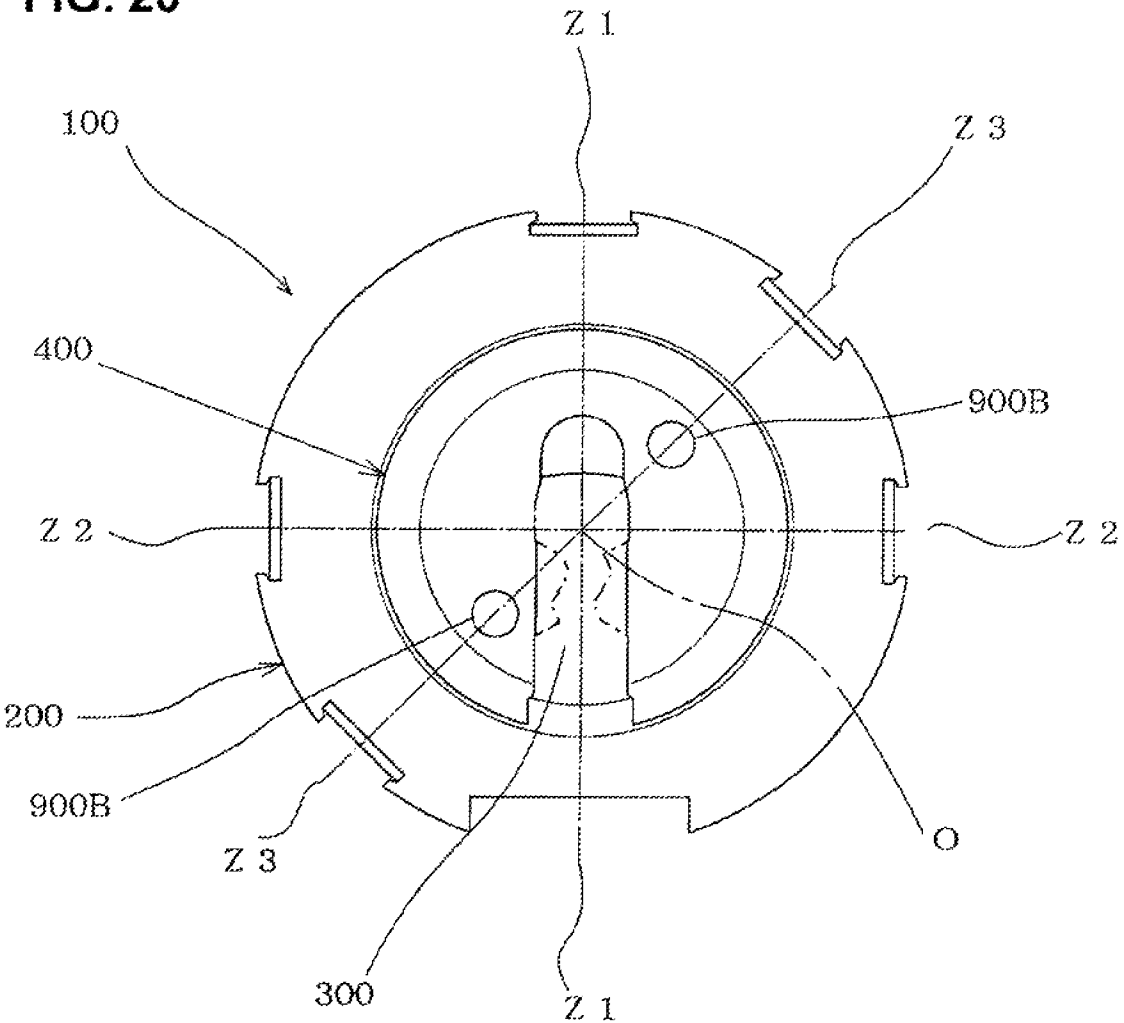
FIG. 20 is a front view of a cylinder lock of the patent document 3.
Figure 21:
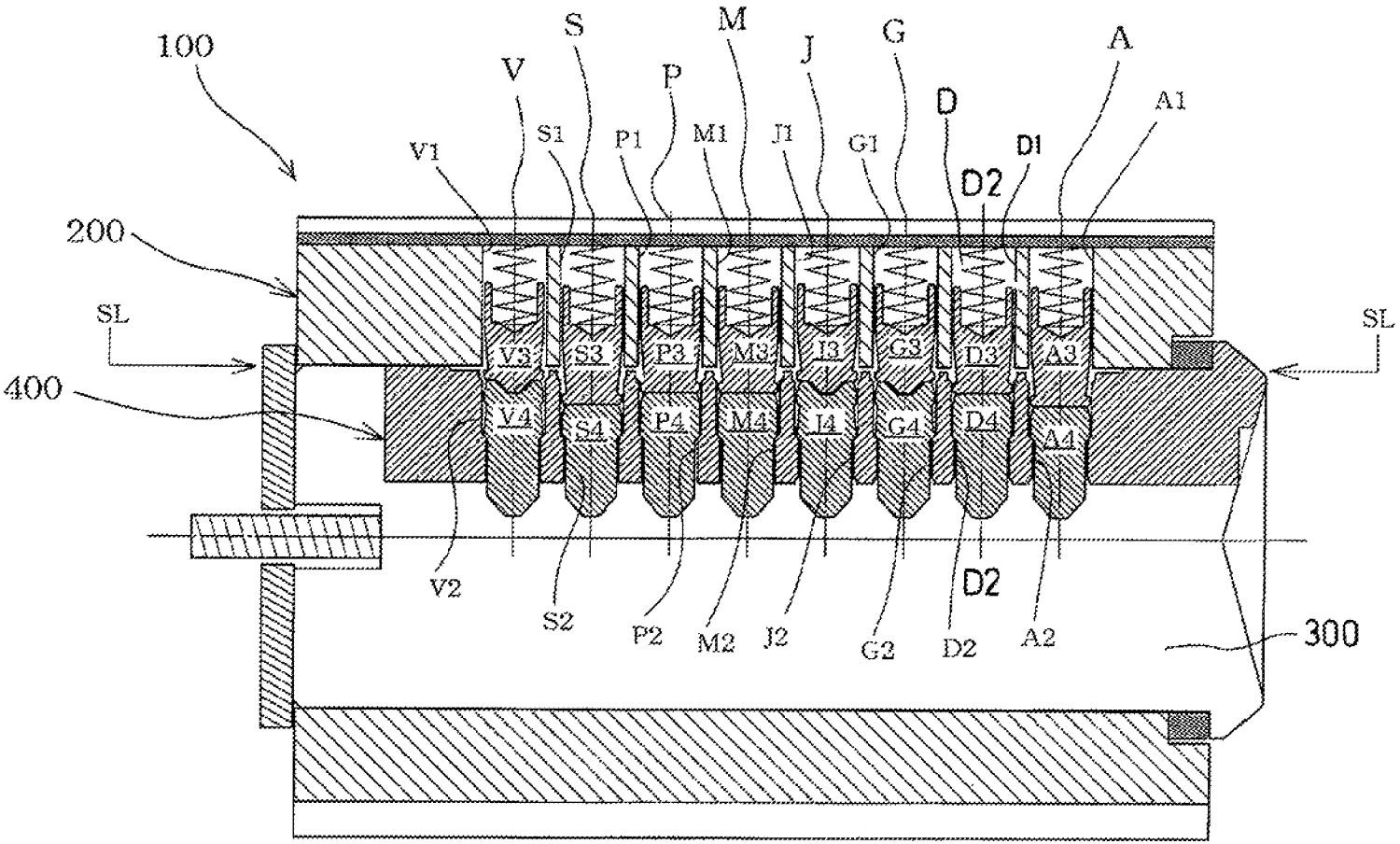
FIG. 21 is a sectional view taken in the line Z1-Z1 in FIG. 20.
Figure 22:
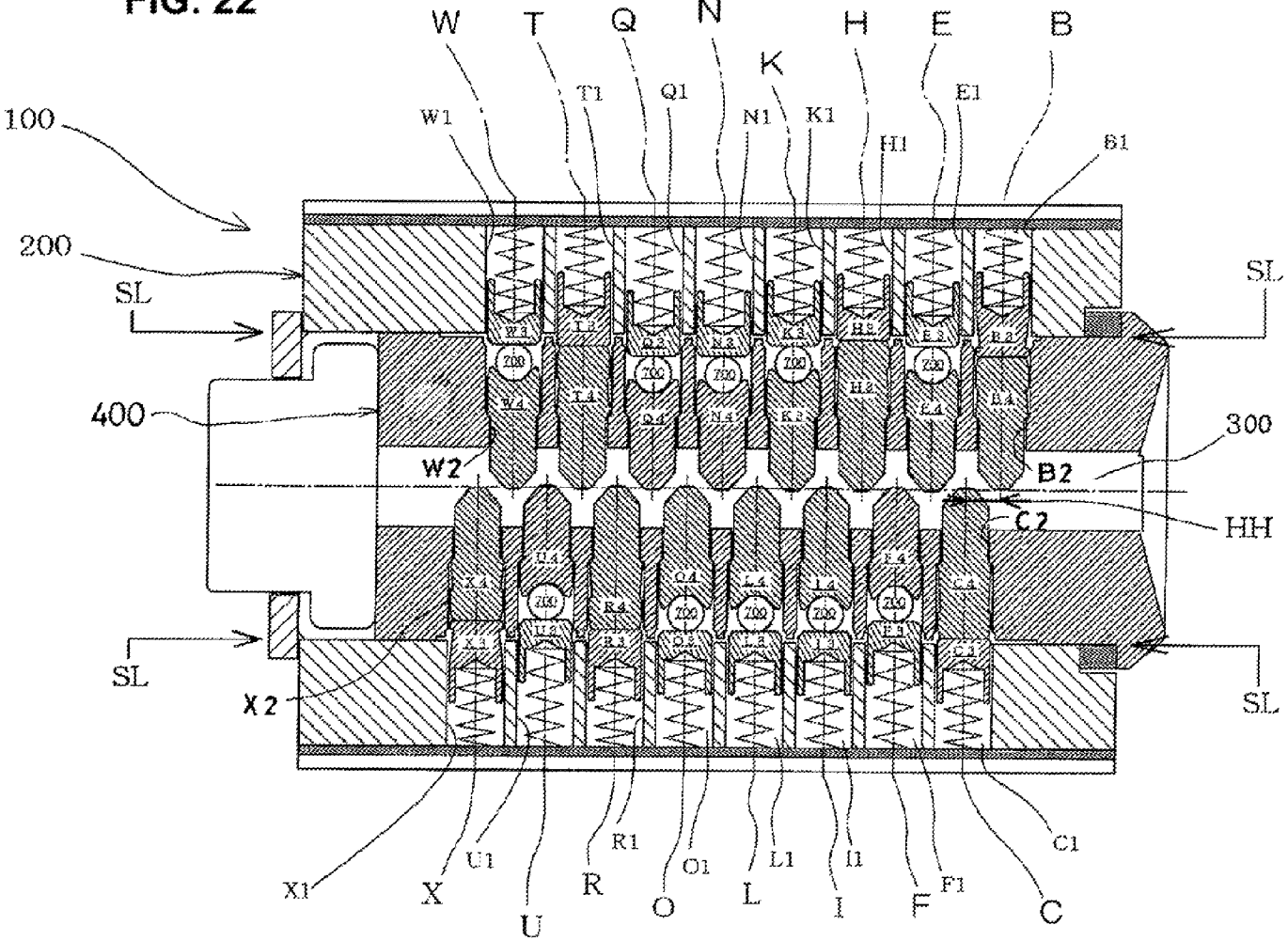
FIG. 22 is a sectional view taken in the line Z2-Z2 in FIG. 20.
Figure 23:
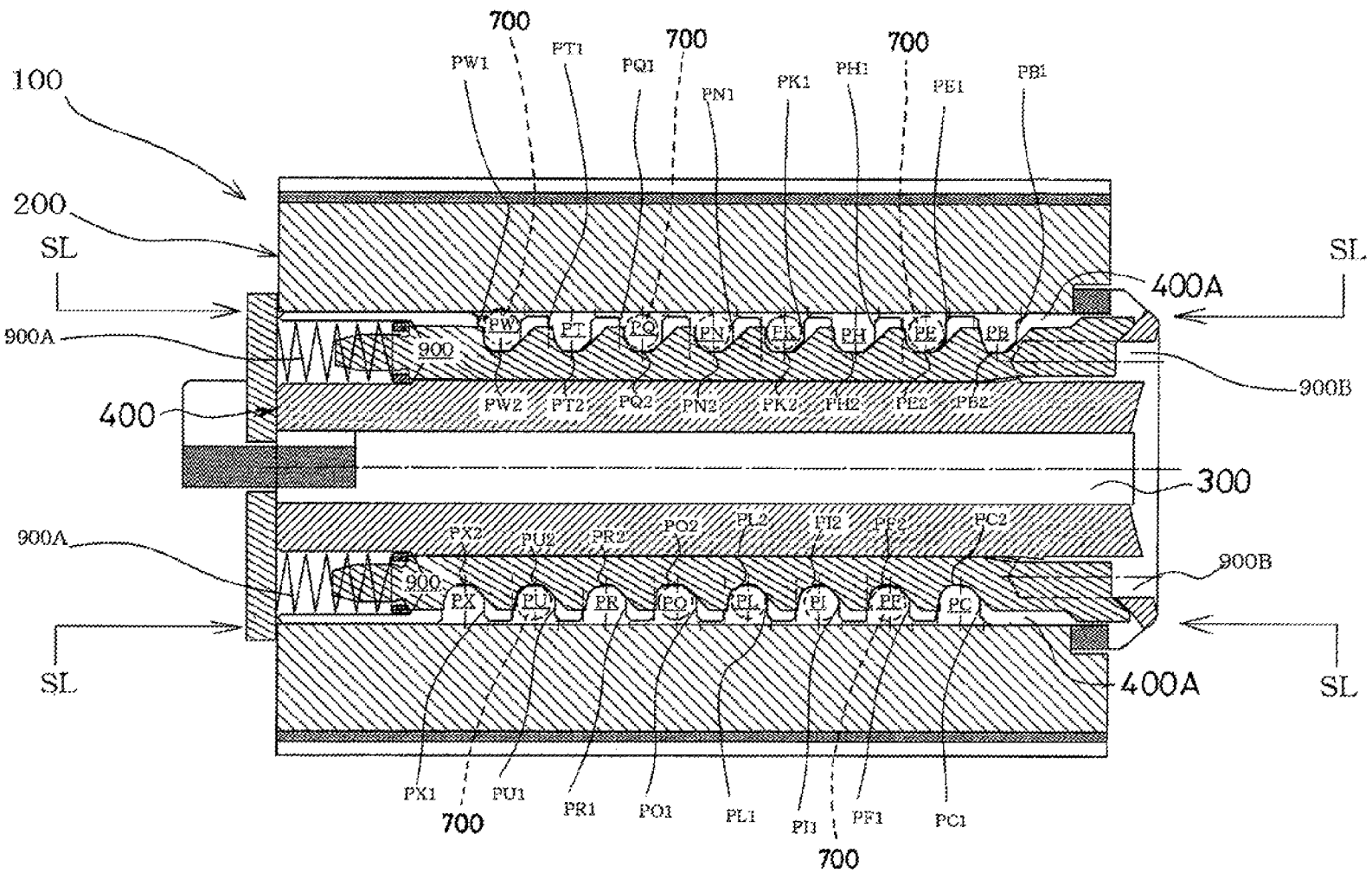
FIG. 23 is a sectional view taken in the line Z3-Z3 in FIG. 20.
Figure 24:
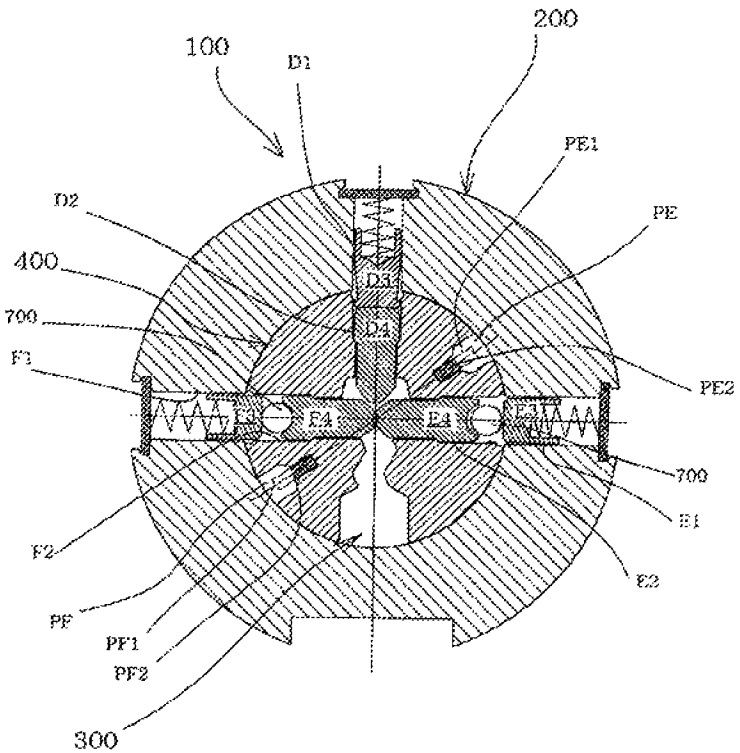
FIG. 24 is a sectional view taken in the lines D2-D2 and E-F in FIGS. 21 and 22.
Figures 25A, 25B, 25C:
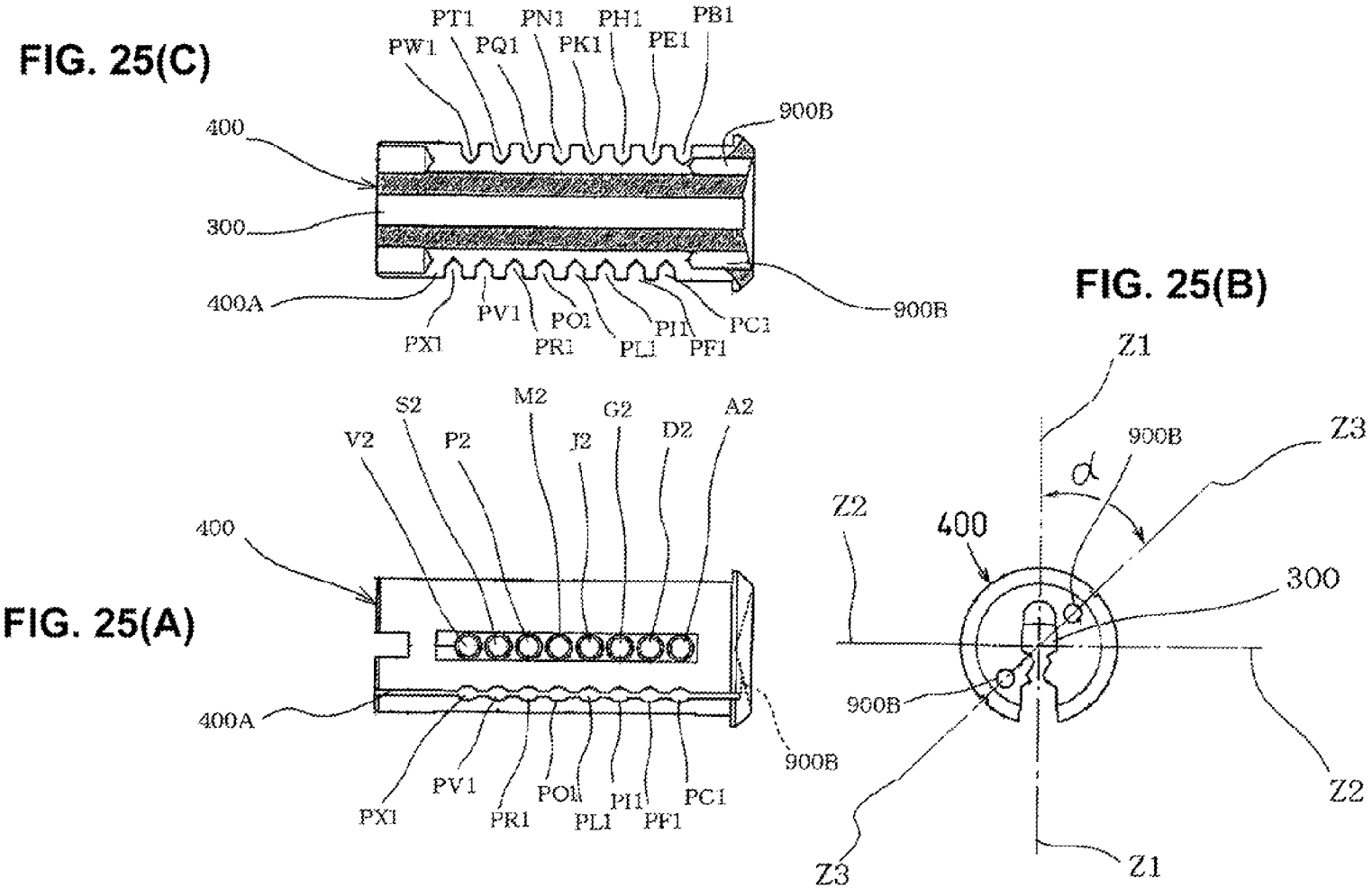
FIG. 25 shows an inner cylinder, FIG. 25(A) a side view of the inner cylinder, FIG. 25(B) a front view of the inner cylinder, and FIG. 25(C) a sectional view taken in the line Z3-Z3 in FIG. 25(B).
Figure 26:
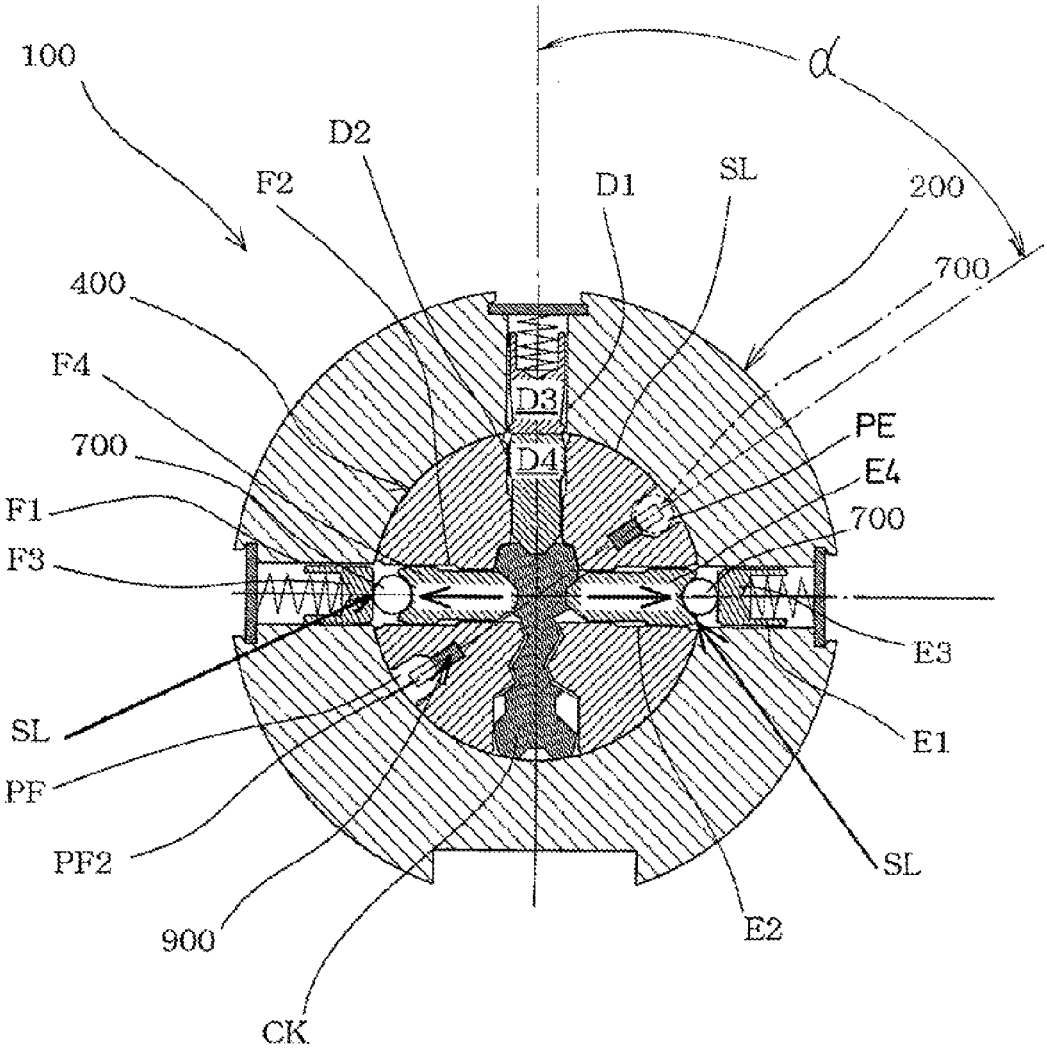
FIG. 26 is a sectional view taken in the lines D2-D2 and E-F in FIGS. 21 and 22 showing the situation that a key (a change key) is inserted into the keyway of the cylinder lock in the reset state in FIGS. 21, 22.
Figure 27A:
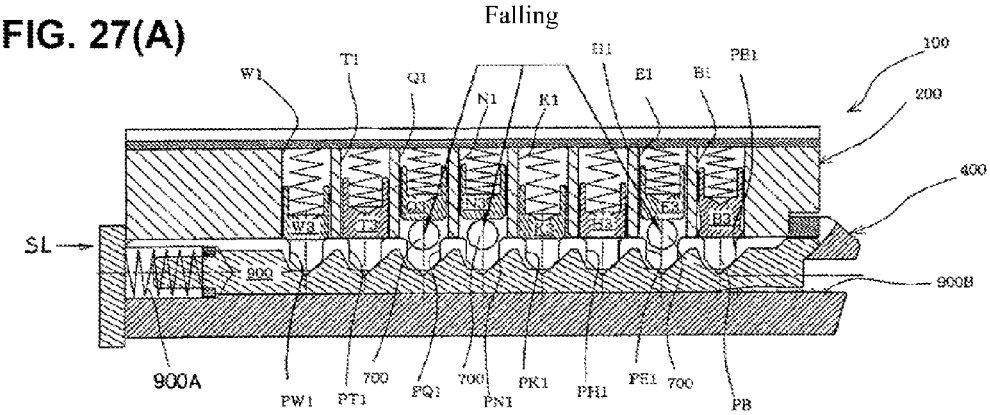
FIG. 27 is a sectional view taken in the line Z2-Z2 in FIG. 20 showing the case that a key (a change key) is inserted into a keyway in the reset state and turned clockwise in angle of $\alpha$ (about 45 degrees), FIG. 27(A) a partially cutout sectional view of a principal part showing the situation before the auxiliary tumblers fall into the accommodation pockets, FIG. 27(B) a partially cutout sectional view of the principal part showing the situation that the auxiliary tumblers have fallen into the accommodation pockets, and FIG. 27(C) a partially cutout sectional view of the principal part showing the situation that the reset member is pushed into by the control member to thereby push up the auxiliary tumblers.
Figure 27B:
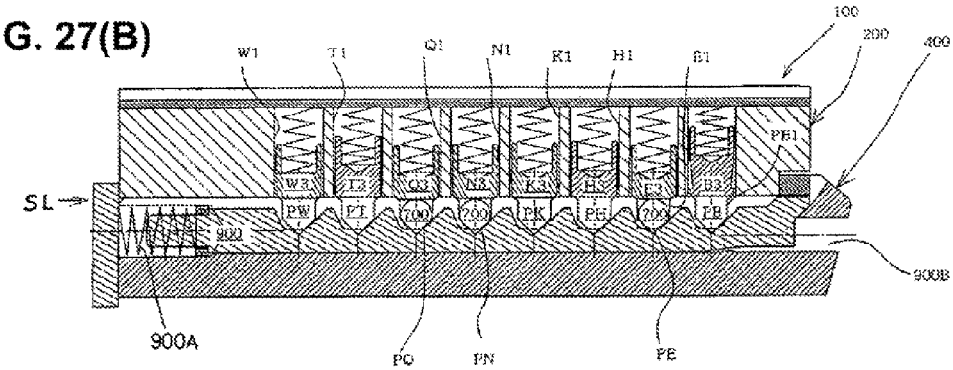
Figure 27C:
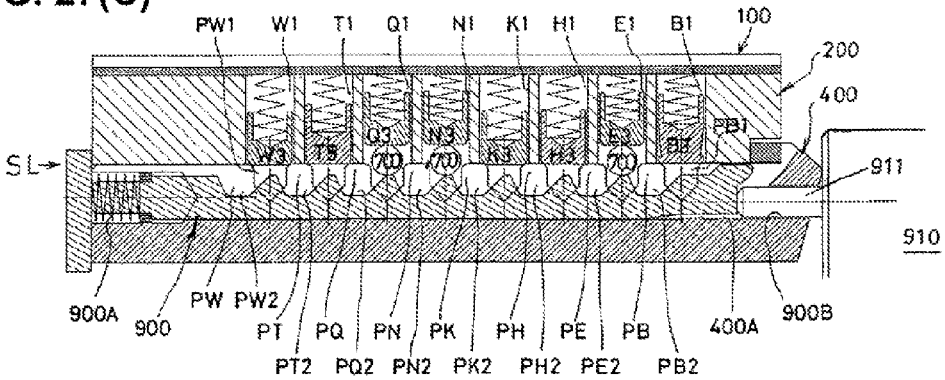

In the patent document 3, when providing the cylinder lock 100 with the feature that a master key is capable of being set, a specific serration/surface figuration of the master key is set to be so arranged that all of the ten auxiliary tumblers 700 of the cylinder lock 100 shown in FIG. 22 (a cross section taken in the line Z2-Z2 in FIG. 20) are able to be pushed up against the springs of the upper tumblers A3-X3 to thereby be placed into the upper pin chambers A1-X1. As a result, in any states set by use of any other change keys CK, the cylinder lock is able to be unlocked by use of the newly set master key.

However, in that case, the cylinder lock 100 has such a problem that when the newly set master key is inserted into the keyway 300 and turned clockwise a degrees, all of the auxiliary tumblers automatically fall into the accommodation pockets to be accommodated there, resulting in that the cylinder lock is automatically set into a state that it cannot be locked or unlocked by means of other change key(s) (the "shut-out" state), namely, once the master key is used, the cylinder lock is no more locked or unlocked using other change key(s) CK and thereby the master key does not fill the inherent role of a master key.

For filling the inherent role of a master key, irrespective of that what change keys have been set as adaptable keys with respect to a plurality of cylinder locks, it is essential that the newly set single master key is able to lock and unlock the cylinder lock while any change key(s) CK previously set as the child key is to be usable continuously as adaptable key(s). However, in the foregoing cylinder lock of the previous application's invention, there is such problem that the master key is once used, change key(s) previously set as a child key are no more applicable as adaptable keys.

An object of the present invention is to provide a novel cylinder lock solving the foregoing problems of the previous application's invention.

Means for Solving the Problems

The present invention provides a cylinder lock having features of a reset state that between an upper tumbler and a lower tumbler of any or all of pairs of the upper tumbler and the lower tumbler is interposed an auxiliary tumbler, (the upper tumblers being formed plurally longitudinally of an outer cylinder of the cylinder lock, the lower tumblers corresponding to the upper tumblers and being arranged in an inner cylinder), so that the cylinder lock can be locked and unlocked with a plural kinds of keys adapted to a key way of the cylinder lock, and a set state that in the reset state any or all of the plural auxiliary tumblers each interposed between the upper and the lower tumblers are moved aside from between the upper tumblers and the lower tumblers with an outside operation, whereby accommodating the moved auxiliary tumblers into accommodation holes formed on the inner cylinder and holding the state of the auxiliary tumblers in the accommodation holes, so that the cylinder lock can be locked and unlocked by means of a specific key among a plural types of keys the cylinder lock being capable of being locked and unlocked by means also of a master key.

A cylinder lock of the present invention is a cylinder lock which comprises an outer cylinder longitudinally having a plurality of upper tumbler bores, and an inner cylinder which is fit into the outer cylinder in a manner of being capable of freely rotated and has a plurality of lower tumbler bores connecting with a keyway and corresponding to the plural upper tumbler bores in the outer cylinder, further, upper tumblers inserted into the upper tumbler bores of the outer cylinder and urged by a spring toward the inner cylinder, lower tumblers inserted into the lower tumbler bores of the inner cylinder, and auxiliary tumblers interposed between the upper tumblers and the lower tumblers of spontaneously selected pairs of upper tumblers and lower tumblers, so that the auxiliary tumblers can be moved aside from between the upper tumblers and the lower tumblers, thereby enabling a change of keys for locking and unlocking the cylinder lock; wherein there are formed a plurality of elongated accommodation holes longitudinally of the outer peripheral surface of the inner cylinder, and there is formed a groove connecting with the plural accommodation holes;

the elongated accommodation holes are each formed in such region that when the inner cylinder is turned at a predetermined angle to cause the elongated accommodation holes to be positioned facing the upper tumbler bores, a longitudinal distance of the accommodation holes extends correspondingly to an extent from one upper tumbler bore facing the accommodation hole to a partition wall adjoining to the one upper tumbler bore to separate this bore from an adjoining next upper tumbler bore;

a set/reset member is arranged to slide freely in the groove, the set/reset member being provided in the longitudinal direction with crests and roots formed alternately continuously to each other, a tapered part being provided behind each root and in front of each crest, and a stopping part being provided in front of each root and behind each crest, so that there are structured to enable;

a set state that an adaptable key is inserted into the cylinder lock, in a reset state wherein all of the auxiliary tumblers are positioned between the upper tumblers and the lower tumblers, function of serration and surface figuration of the key moves any one of the auxiliary tumblers interposed between the upper tumblers and the lower tumblers into the upper tumbler bores and the remaining auxiliary tumblers are placed in the lower tumbler bores of the inner cylinder, the inner cylinder is turned at a predetermined angle in this situation, the auxiliary tumblers in the upper tumbler bores are brought into a situation of hitting and contacting with crests of the set/reset member, the set/reset member in this situation is pushed by a stroke ST1 longitudinally of the groove, through an outside operation, to move the auxiliary tumblers contacting with the crests to a position of facing the roots, the auxiliary tumblers are accommodated into accommodation holes on the inner cylinder by an urging force of a spring for the upper tumblers, so that when pushing the set/reset member is released, the stopping part of the set/reset member does, by an urging force of a spring for the set/reset member, move the auxiliary tumblers accommodated in the accommodation holes longitudinally of the elongated accommodation holes to a position of facing the foregoing partition wall on the outer cylinder, so that the auxiliary tumblers moved aside from between the upper tumblers and the lower tumblers are held by the partition walls, the accommodation holes, and the stopping parts of the set/reset member; and a reset state that an adaptable key is inserted into the keyway of the inner cylinder, the inner cylinder is turned at a predetermined angle to cause the accommodation holes to face the upper tumbler bores, thereafter, the set/reset member is pushed through an outside operation by a stroke ST2 longer than the length of pushing the set/reset member in the case of making the set state, thereby the auxiliary tumblers in the elongated accommodation holes are moved from a position facing the partition walls on the outer cylinder to a position facing the upper tumbler bores and the lower tumbler bores, and also are pushed toward the upper tumbler bore side through function of the tapered part, and crests in continuation to the tapered parts hold in the upper tumbler bores the auxiliary tumblers pushed into there, then, while keeping the set/reset member in the situation of being pushed, the inner cylinder is turned to a position that the upper tumbler bores and the lower tumbler bores face with each other, and pushing the set/reset member is released, so that the auxiliary tumblers having been temporarily held in the accommodation holes are returned to an initial position between the upper tumblers and the lower tumblers, whereby making the reset state with all of the auxiliary tumblers being positioned between the upper tumblers and the lower tumblers.

(Function)

According to the present invention as foregoing, in a normal situation, when the inner cylinder is turned at a predetermined angle (an angle of $\alpha$ 1°), for example, through operation using a key serving as an "adaptable" key, the crests of the set/reset member are caused to face the upper tumbler bores, so that the set/reset member is pushed by the stroke ST1 by the outside operation to cause the roots in place of the crests to face the upper tumbler bores, enabling the auxiliary tumblers positioned in the upper tumbler bores to be accommodated into the accommodation holes on the inner cylinder thanks to an urging force of the spring fit in the upper tumbler bores. Moreover, when pushing the set/reset member is released, the auxiliary tumbler moved aside from between the upper tumbler and the lower tumbler is moved inside and longitudinally of the elongated accommodation hole and held at a position facing partition walls formed between the upper tumbler bores by means of the stopping part of the set/reset member and with an urging force of the spring for the set/reset member (the set state). In this set state, all or any of the auxiliary tumblers interposed between the upper tumblers and the lower tumblers are accommodated into the accommodation holes, so that locking and unlocking only with a specific key including the key serving as an adaptable key is accepted.

Further, even in case that a key other than the master key has been set to be the adaptable key, if the master key is provided with such serration and surface figuration that when the master key is inserted into the keyway, the auxiliary tumblers interposed between the upper tumblers and the lower tumblers are all pushed to the upper tumbler bore side, and the boundary line between the lower tumbler and the auxiliary tumbler or that between the lower tumblers and the upper tumblers corresponds to the shear line, the cylinder lock (which has been made into the set state by means of a specific key) is able to be locked and unlocked with the master key. Besides, when the master key turns the inner cylinder for locking or unlocking the cylinder lock, unless operation for the "setting" by the set/reset member using the outside operation is performed, the auxiliary tumbler temporarily positioned in the upper tumbler bore on the outer cylinder through the master key's insertion into the keyway is prevented, from being accommodated into the accommodation holes on the inner cylinder, by the crests of the set/reset member. Thus, even when the cylinder lock is locked or unlocked temporarily with locking/unlocking operation by the master key, unless the "setting" operation by the set/reset member through the outside operation is performed, the specific key which has been previously set is also able to function as the adaptable key to lock and unlock the cylinder lock.

Furthermore, the key serving as the adaptable key or the master key is inserted into the keyway and turned at a predetermined angle (an angle of $\alpha$1°), whereby the auxiliary tumbler being accommodated in the accommodation hole is caused to face the upper tumbler bore. Thereafter, the set/reset member is pushed, by outside operation, by the stroke ST2 longer than the stroke ST1 for the setting operation, whereby the auxiliary tumbler in the accommodation bore is moved inside the elongated accommodation bore from a position facing the partition wall on the outer cylinder to a position facing the upper and the lower tumbler bores, and the tapered part of the set/reset member functions to push up the auxiliary tumbler from the accommodation hole to the side of the upper tumbler bore against the urging force of the spring for the upper tumbler. And with keeping the situation, the key is turned at an angle of $\alpha$1° to return to an original situation and the pushing operation for the set/reset member is released, so that the set/reset member is moved backwards returning to its situation before the above-mentioned pushing operation, thereby causing the auxiliary tumblers to move back to between the upper tumblers and the lower tumblers thereby enabling the reset state with all of the auxiliary tumblers being positioned between the upper tumblers and the lower tumblers (the reset state). In this case, the present invention provides that even with the master key other than the specific key set as the adaptable key, the reset state is realized. Thus, for example, even when a specific key which has been set as the adaptable key is lost, first, the master key is used to make the reset state, then, any other change key can be set as an adaptable key.

The foregoing set/reset member is so structured that it is, in the Examples described later, provided with a spring which always urges the set/reset member backward. When being pushed forward with the outside operation, the set/reset member is pushed against the urging force of the spring. When the outside operation is released, the set/reset member is automatically moved backward with the urging force of the spring. The present invention is not limited to this feature. The set/reset member may otherwise be so structured that it is operated to move, so that when the outside operation is released, the roots of the set/reset member corresponds to the accommodation holes. For this structure, such a feature (other than the foregoing method always urging the set/reset member backward by use of the spring) may be used that the set/reset member is made of a substance to undergo magnetism while an outside operation member is made of a magnetic substance, so that the set/reset member can be operated to be moved forward and backward by use of magnetism. Another method making use of magnetism is such that instead of the foregoing spring, in order to enable the set/reset member to be always urged backward, at least front end side or rear end side of the set/reset member is made of a magnetic substance. And at the front end side or rear end side of the groove in the inner cylinder (through which the set/reset member is inserted) is provided a magnetic substance having different polarity from the set/reset member, so that resiliency of magnetic substances each having different polarities is made use of for structuring to always urge the set/reset member forward.

A cylinder lock of the present invention comprises:

a cylinder lock wherein at the front of an inner cylinder where formed the keyway, and plurality of accommodations holes, and a groove is provided an insertion bore for a set/rest pin;

a first jig which holds a key (to be inserted into the keyway for the setting operation), so that when the key is inserted into the keyway, the first jig's first pin having a first length is inserted into the set/reset pin insertion bore, and when the first pin having the first length is pushed into completely by the stroke ST1 the set/reset member is operated, through the outside operation, to change its situations from that the crests face the upper tumbler bores to that the roots face the upper tumbler bores; and a second jig which holds a key (to be inserted into the keyway for the resetting operation), so that when the key is inserted into the keyway, the second jig's second pin having a second length longer than said first length is inserted into the set/reset pin insertion bore, and when the second pin having the second length is pushed into completely by the stroke ST2, the auxiliary tumblers in the situation positioned on the roots of the elongated accommodation holes are pushed to the side of the upper tumbler bores thanks to function of the tapered parts in continuation to the roots.

Effect of the Invention

According to the present invention, the auxiliary tumbler can be accommodated into the accommodation hole on the inner cylinder without necessity of taking out the auxiliary tumbler from between the upper tumblers and the lower tumblers to the outside of the cylinder lock. The auxiliary tumbler accommodated hole in the accommodation is able to be returned to between the upper tumblers and the lower tumblers again, through the foregoing outside operation. Hence, many key-changes are enabled on the basis of combinations of interposition patterns of the auxiliary tumblers between the upper tumblers and the lower tumblers with respect to any spontaneous plural pairs of the upper and the lower tumblers. In addition, the feature that the auxiliary tumblers once moved from between the upper tumblers and the lower tumblers to the accommodation holes are returned to the initial positions between the upper tumblers and the lower tumblers enables the keys made temporarily unusable to be repeatedly recovered to be usable.

The accommodation holes to temporarily accommodate the auxiliary tumblers moved aside are of an elongated elliptical shape. And the auxiliary tumblers accommodated in the accommodation holes are moved longitudinally of the elongated elliptical-shaped accommodation holes to be held at a position facing the partition walls formed between the upper tumbler bores on the outer cylinder, so that the auxiliary tumblers are not at all erroneously moved into the tumbler bores unless the set/reset member is pushed into.

Besides, the pushing-into of the set/reset member by the stroke ST1 causes the roots of the set/reset member to be shifted to a position facing the upper tumbler bores, so that the auxiliary tumbler positioned at the side of the upper tumbler bores falls onto the roots to be accommodated in the accommodation holes. And releasing the pushing-into of the set/reset member causes the auxiliary tumbler to be held at a position facing the partition walls on the outer cylinder as foregoing. In this instance, any auxiliary tumblers having been held in the accommodation holes are only moved inside the elongated elliptic-shaped accommodation holes and kept to be held as their previous situation. (the set state).

When the set/reset member is pushed into by the stroke ST2 longer (larger) than the stroke ST1, the auxiliary tumblers held in the accommodation hole are moved to a position facing the tumbler bores and each pushed to the side of the upper tumbler bores on the outer cylinder (the reset state). In this way, pushing operation for the set/reset member in two stages enables two kinds of conflicting operation, i.e., the set operation and the reset operation. And, unless carrying out the set operation, the key having made locking or unlocking the cylinder lock cannot make the set state. Thus, when a master key (which is able to lock and unlock even in case that whatever adaptable keys are set to be usable) is once employed to lock or unlock the cylinder lock, but not performing the set operation, then, an adaptable key previously set remain usable.

EXAMPLES

Example 1

A cylinder lock according to Example 1 of the present invention will be detailed with referring to FIGS. 1 through 19. Difference between the cylinder lock 1 of the present invention and a cylinder lock 100 of the previous application disclosed in the patent document 3 shown in FIGS. 20 through 27 is an improvement of the inner cylinder 400 the reset member 900, and a control member 910. Other features adopted in these cylinder locks are substantially identical.

(Reset State) Next, the cylinder lock will be detailed with referring to the cylinder lock in the reset state shown in FIGS. 1 to 6.

The cylinder lock in the reset state can be unlocked by use of a master key MK which is able to lock and unlock a plurality of cylinder locks, and also by use of all of specific change keys CK which are each able to lock and unlock a respective cylinder lock of a plurality of cylinder locks.

Figure 1:
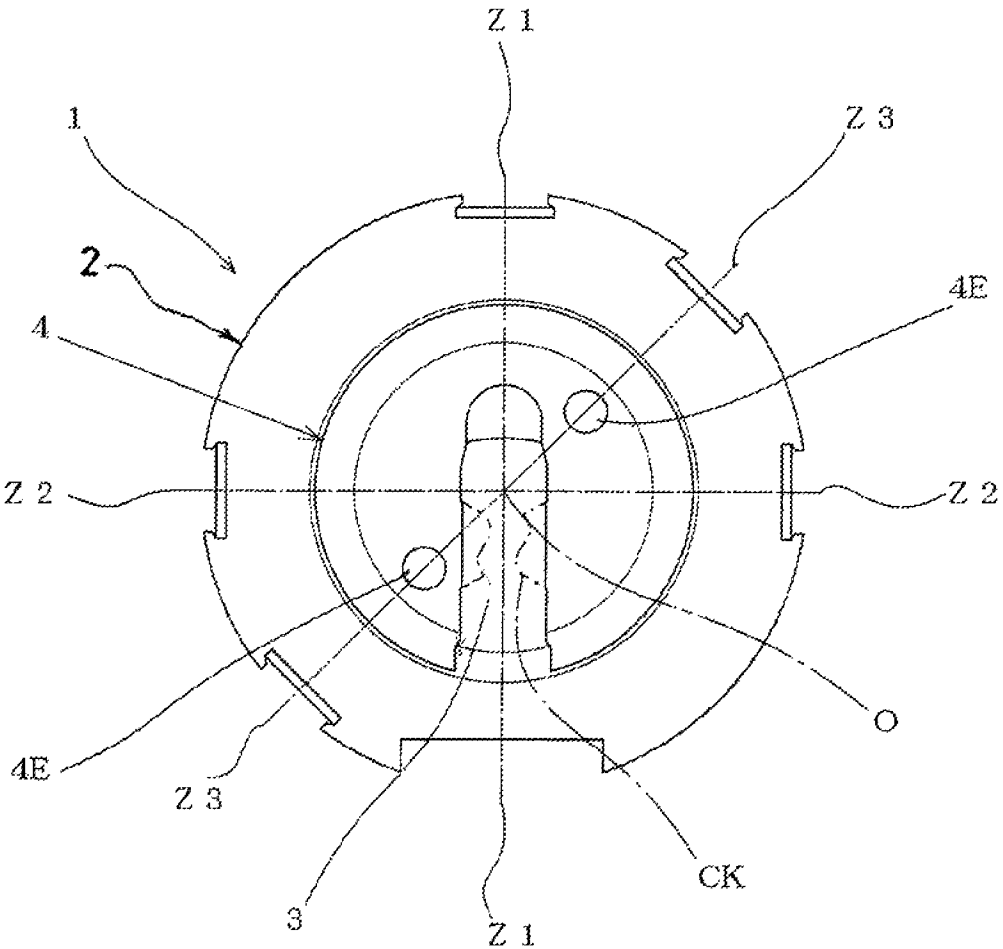
FIG. 1 is a front view of a cylinder lock of Example 1 according to the present invention.
Figure 2:
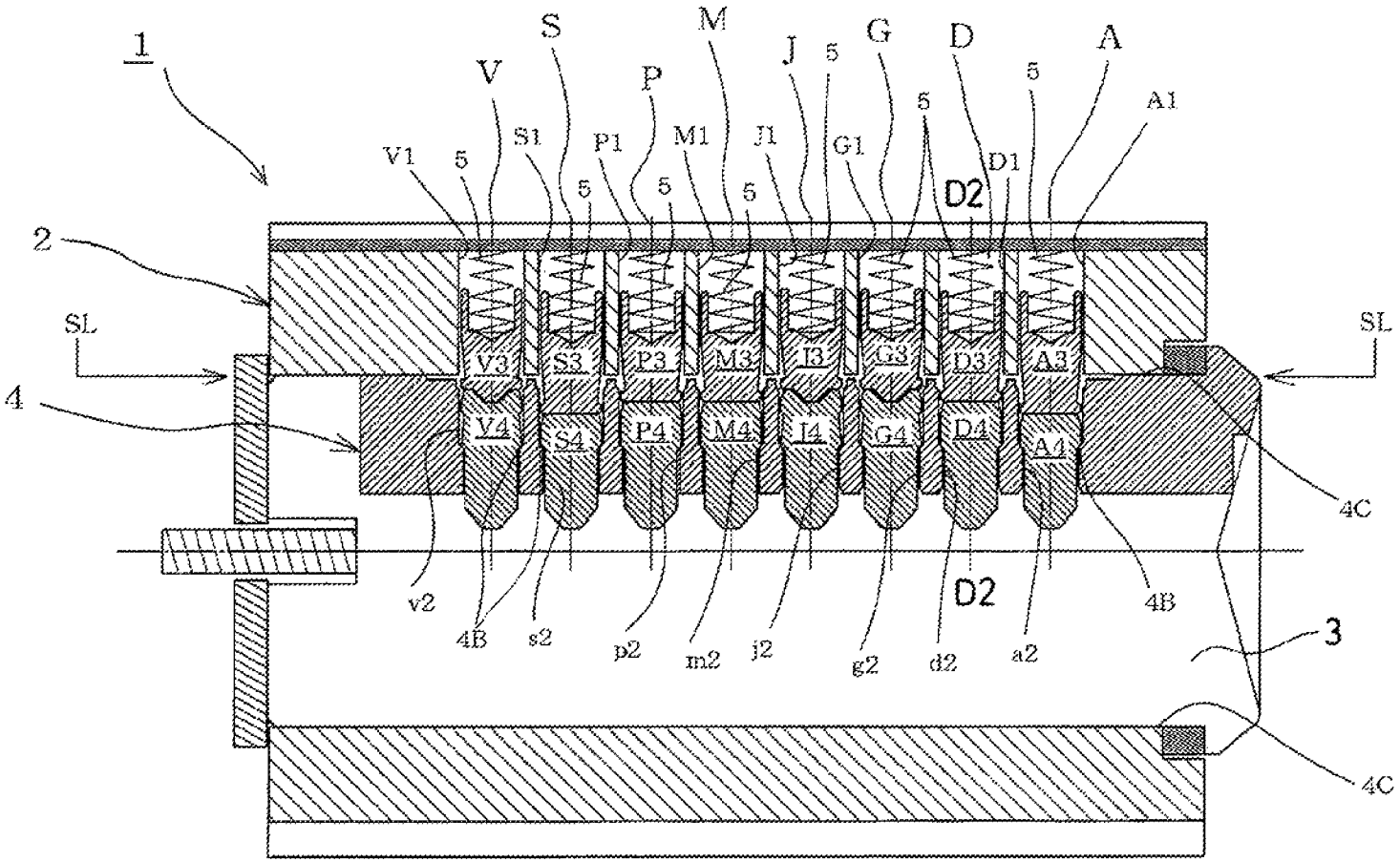
FIG. 2 is a longitudinal sectional view taken in the line Z1-Z1 in FIG. 1.
Figure 3:
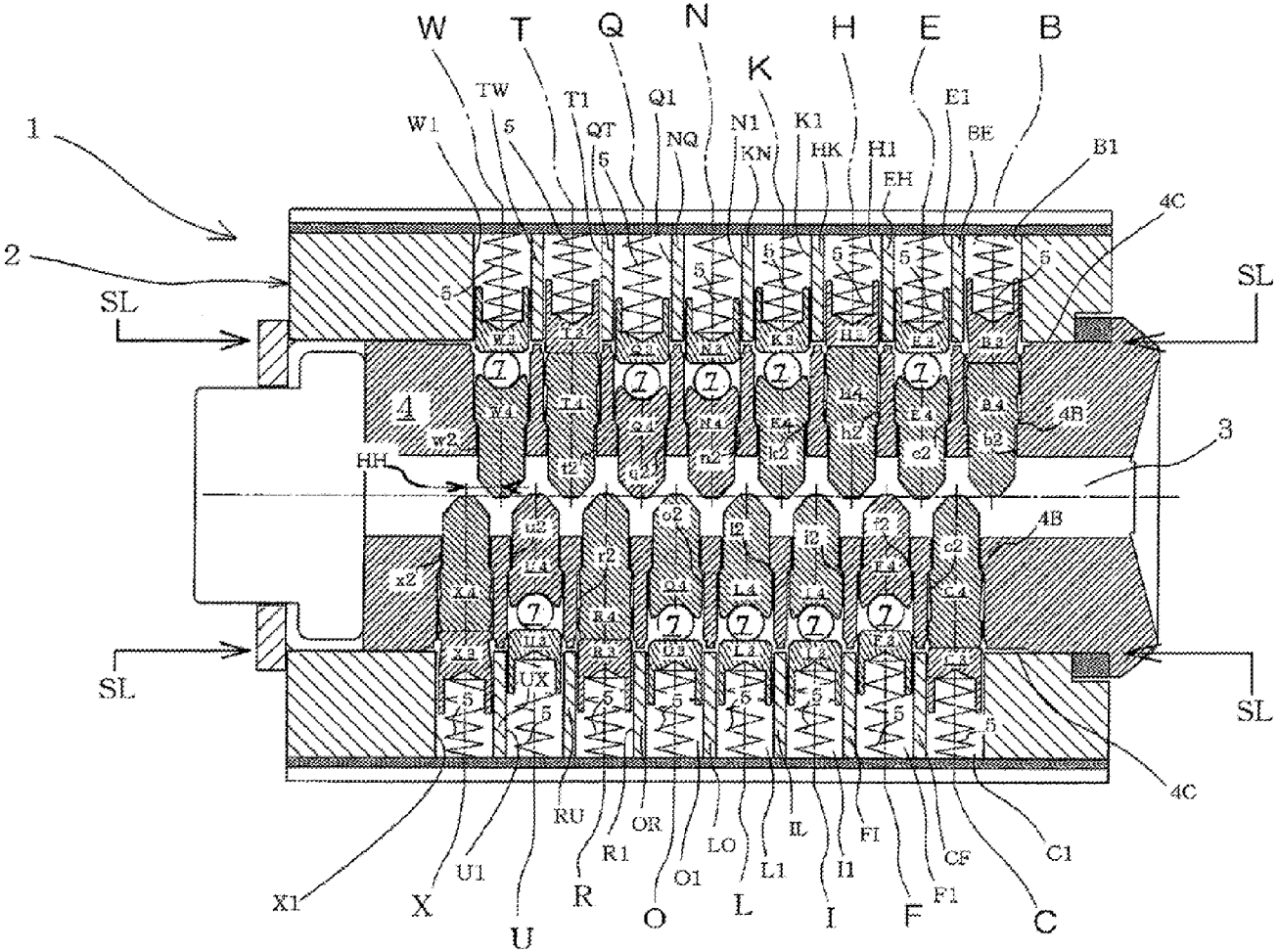
FIG. 3 is a sectional view taken in the line Z2-Z2 in FIG. 1.
Figure 4:
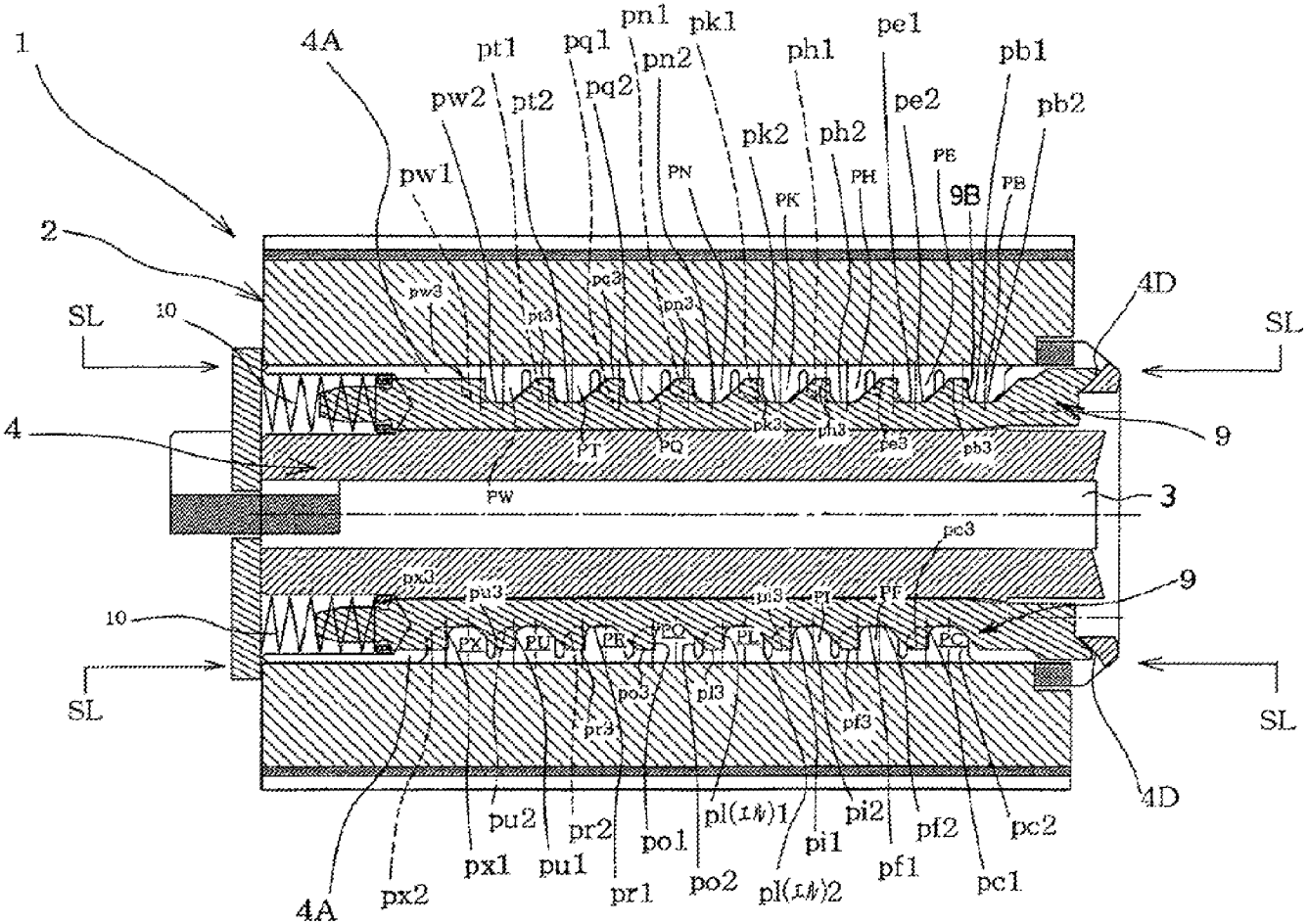
FIG. 4 is a sectional view taken in the line Z3-Z3 in FIG. 1.
Figure 5:
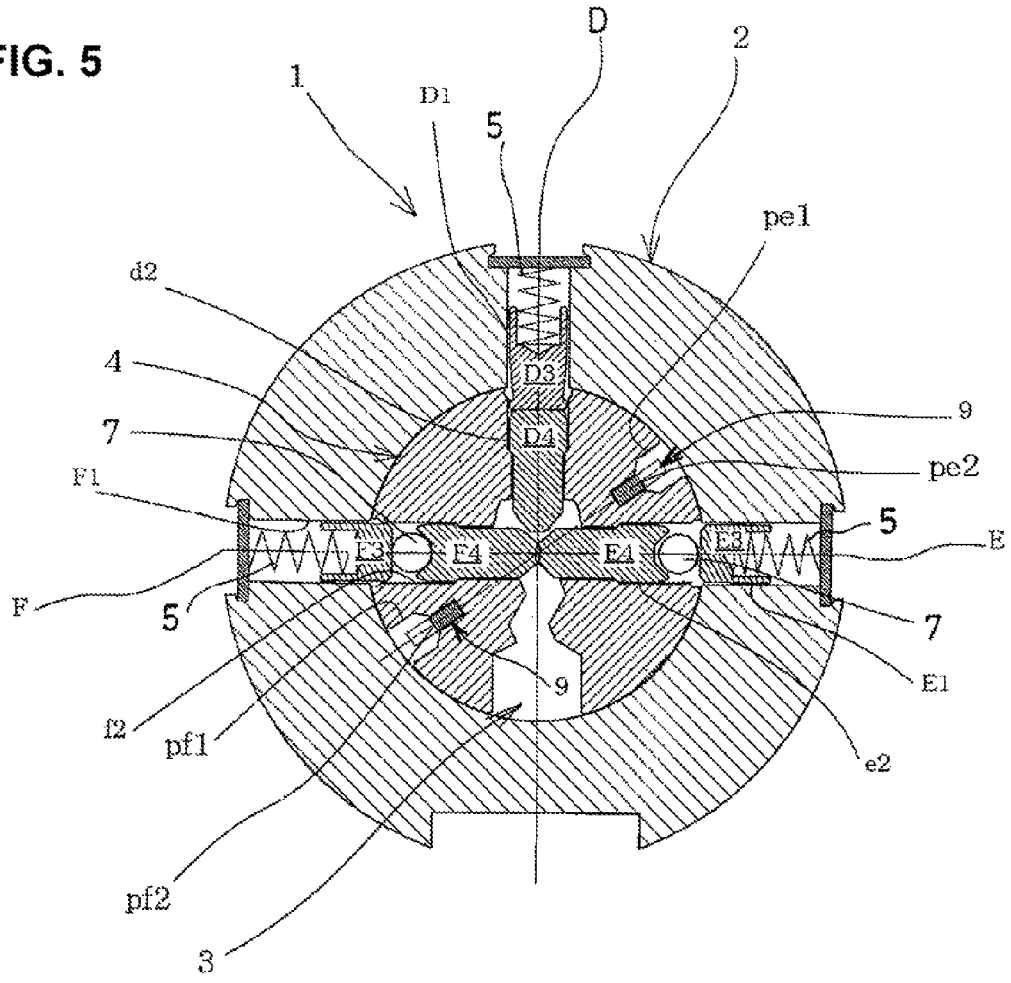
FIG. 5 is a sectional view taken in the lines D2-D2 and E-F in FIGS. 2 and 3.
Figure 6C:
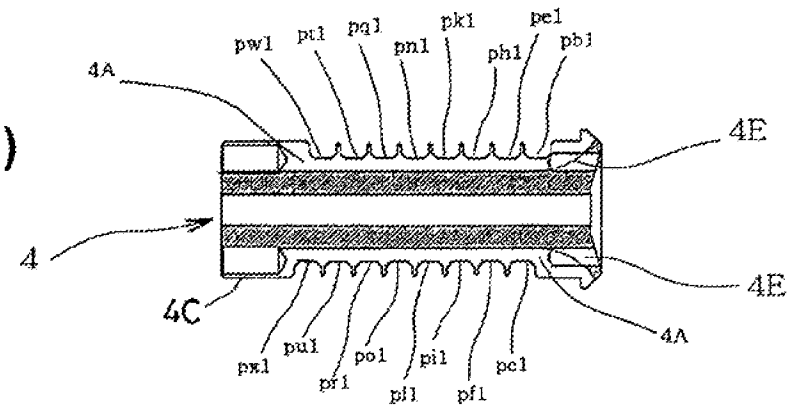
FIG. 6 shows an inner cylinder, FIG. 6(A) a side view of the inner cylinder, FIG. 6(B) a front view of the inner cylinder, and FIG. 6(C) a sectional view taken in the line Z3-Z3 in FIG. 6(B).
Figure 6B:
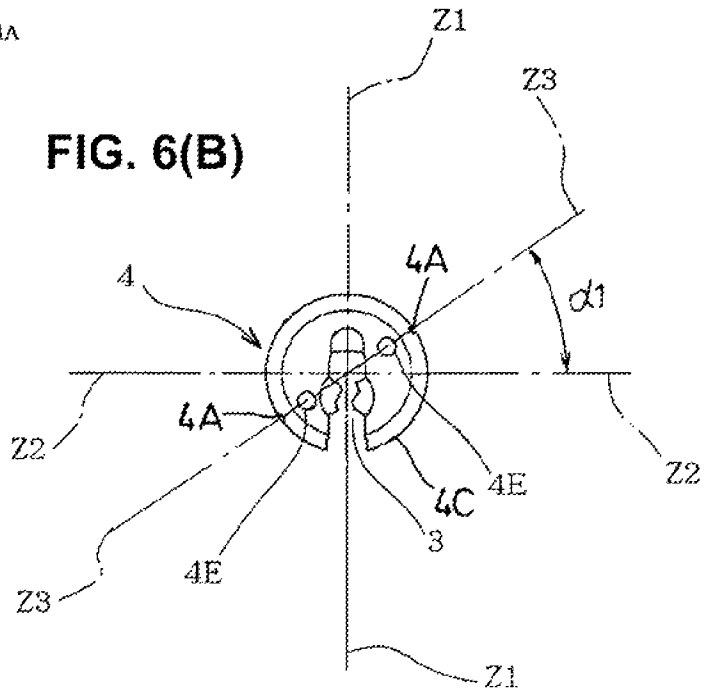
Figure 6A:
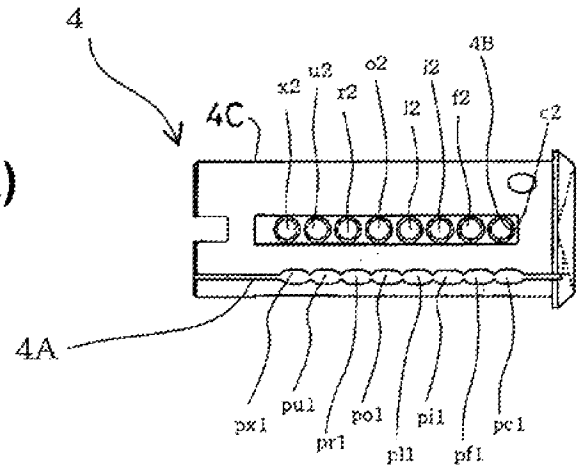

FIG. 1 is a front view of a cylinder lock according to the present invention, FIG. 2 a longitudinal sectional view taken in the line Z1-Z1 in FIG. 1, FIG. 3 a sectional view taken in the line Z2-Z2 in FIG. 1, FIG. 4 a sectional view taken in the line Z3-Z3 in FIG. 1, FIG. 5 a sectional view taken in the lines D2-D2 and E-F in FIGS. 2 and 3, respectively, and FIG. 6(A) a side view of an inner cylinder 4, FIG. 6(B) a front view of the inner cylinder 4, and FIG. 6(C) a sectional view taken in the line Z3-Z3 in FIG. 6(B).

In the drawings, 1 is a cylinder lock which mainly comprises: an outer cylinder 2 longitudinally having a plurality of upper tumbler bores A1-X1 (arranged in this Example at the upper side are eight upper tumbler bores A1, D1, G1, J1, M1, P1, S1, V1, at the right side eight upper tumbler bores B1, E1, H1, K1, N1, Q1, T1, W1, and at the left side eight upper tumbler bores C1, F1, I1, L1, O1, R1, U1, X1); an inner cylinder 4 which fit into the outer cylinder 2 in a manner of being freely rotatable and has a keyway 3 and lower tumbler bores a2-x2 corresponding to the upper tumbler bores A1-X1 of the outer cylinder 2; and upper tumblers A3-X3 and lower tumblers A4-X4 each inserted into respective columns A-X formed by the upper tumbler bores A1-X1 and lower tumbler bores a2-x2.

The lower tumbler bore a2-x2 is provided with a stepped part 4B which limits the amount of projecting of the lower tumblers A4-X4 into the keyway 3 and prevents the lower tumblers from falling out. A spring 5 is arranged in the upper tumbler bores A1-X1 and urges the upper tumblers A3-X3 inserted in the upper tumbler bores A1-X1 in the direction of hitting and contacting with the lower tumblers A4-X4.

As shown in FIGS. 1 and 2, along a virtual plane extending with respect to a virtual center O and the point Z1, the inner cylinder 4 and the outer cylinder 2 inwardly have a first column group including columns A, D, G, J, M, P, S, V (formed with the eight upper tumbler bores A1, D1, G1, J1, M1, P1, S1, V1, on the outer cylinder 2 and the lower tumbler bores a2, d2, g2, j2, m2, p2, s2, v2 on the inner cylinder 4 corresponding to the upper tumbler bores) arranged in a row and at a fixed interval. Similarly, as shown in FIGS. 1 and 3, along a half of a virtual plane extending with respect to the virtual center O and the line Z2-Z2, the inner cylinder 4 and the outer cylinder 2 inwardly have a second column group including columns B, E, H, K, N, Q, T, W (formed with the plural upper tumbler bores B1, E1, H1, K1, N1, Q1, T1, W1, and the plural lower tumbler bores b2, e2, h2, k2, n2, q2, t2, w2) arranged in a row and at a fixed interval. And, along another half of a virtual plane extending with respect to the virtual center O and the line Z2-Z2, the inner cylinder 4 and the outer cylinder 2 inwardly have a third column group including columns C, F, I, L, O, R, U, X (formed with the plural upper tumbler bores C1, F1, I1, L1, O1, R1, U1, X1, and the plural lower tumbler bores c2, f2, i2, l2, o2, r2, u2, x2) arranged in a row and at a fixed interval.

The second columns group and the third columns group are arranged to be shifted in position from each other at a predetermined interval HH longitudinally of the inner cylinder 4 and outer cylinder 2 (see FIG. 3). With that the columns groups are shifted in position for provision at a predetermined interval HH, and that the two groups have identical or the same pitches between adjoining columns, in order to solve such problem that the auxiliary tumblers 7 positioned in any one of the second and the third columns groups move to the other group, any of the lower tumblers B4, C4, E4, F4, H4, I4, K4, L4, N4, O4, Q4, R4, T4, U4, W4, X4 in the second and the third columns groups is set not to face the upper tumbler bores of both columns groups.

Besides, the first columns group is arranged at a position to be shifted in position by half of the foregoing position-shifting HH between the second and the third columns groups with respect to these groups. In detail, the position of the tumblers bores of the first, second and third columns groups are all adapted as prevented from aligning mutually.

The position-shifting as set among the first, the second and the third columns groups functions to prevent the auxiliary tumblers 7 (positioned in the first, the second and the third columns groups) from erroneously moving to columns of the other group when the auxiliary tumblers undergo the reset state and then the set state, and changes over to the reset state again.

And in the cylinder lock 1 in the foregoing reset state, the auxiliary tumblers 7 are interposed between the upper tumblers E3, F3, I3, K3, L3, N3, O3, Q3, U3, W3 and the lower tumblers E4, F4, I4, K4, L4, N4, O4, Q4, U4, W4. FIG. 3 shows the situation that all the auxiliary tumblers 7 (ten tumblers in the Example) provided in the cylinder lock 1 are interposed between the upper tumblers E3, F3, I3, K3, L3, N3, O3, Q3, U3, W3 and the lower tumblers E4, F4, I4, K4, L4, N4, O4, Q4, U4, W4. In the reset state, and of a preliminarily prepared (set) change-key(s) and a master key may be usable for operation. And a key which is able to lock and unlock the cylinder lock can be set by moving aside one or plural auxiliary tumbler(s) 7 at an appropriate point among the auxiliary tumblers 7 interposed between the upper tumblers E3, F3, I3, K3, L3, N3, O3, Q3, U3, W3 and the lower tumblers E4, F4, I4, K4, L4, N4, O4, Q4, U4, W4, and, after making the reset state again, a different auxiliary tumbler(s) may be moved aside to thereby enable setting of a different fresh key. In this practical feature, the number of the auxiliary tumblers 7 interposed between the upper tumblers and the lower tumblers is ten. The present invention is not limited to this. For example, in addition to between the upper tumblers E3, F3, I3, K3, L3, N3, O3, Q3, U3, W3 and the lower tumblers E4, F4, I4, K4, L4, N4, O4, Q4, U4, W4, the auxiliary tumblers are interposed between the upper tumblers B3, C3, H3, R3, T3, X3 and the lower tumblers B4, C4, H4, R4, T4, X4, whereby sixteen auxiliary tumblers 7 in total are interposed between the upper tumblers and the lower tumblers, so that the number of keys to serve as the adaptable keys can be further increased. Besides, contrarily to the above feature, the number of the auxiliary tumblers 7 can be decreased.

Namely, columns B, C, H, R, T, X into which the upper tumblers B3, C3, H3, R3, T3, X3 and the lower tumblers B4, C4, H4, R4, T4, X4 are fit are fixed columns in which the auxiliary tumblers 7 are not interposed. The columns B, C, H, R, T, X are not limited to this feature and may be so structured that the auxiliary tumblers 7 can be interposed between the upper tumblers and the lower tumblers for the case that it is desired to increase the number of keys that are able to be changed. Also, in case that the number of the fixed columns (in which the auxiliary tumblers 7 are not interposed) is decreased, the number of the auxiliary tumblers 7 in the cylinder lock 1 becomes more than ten in this Example, resulting in increase of the number of keys that are able to be changed. Meanwhile, when the fixed columns are increased, the number of the auxiliary tumblers 7 decreases to be less than ten, resulting in decrease of the number of keys that are able to be changed.

As shown in FIGS. 1, 4 and 6, the inner cylinder 4 is provided with accommodation holes for the auxiliary tumblers 7 (pb1, pc1, pe1, pf1, ph1, pi1, pk1, pl1, pn1, po1, pq1, pr1, pt1, pu1, pw1, px1) at two places on the outer peripheral surface 4C with respect to the virtual center O and along a plane which has the virtual Z3-Z3 line slanted about 55 degrees clockwise from the virtual Z1-Z1 line and extends inward of the inner cylinder 4. In addition, formed on the outer peripheral surface 4C are a groove 4A which connects the plural accommodation holes pb1, pe1, ph1, pk1, pn1, pq1, pt1, pw1, and a groove 4A connecting those pc1, pf1, pi1, pl1, po1, pr1, pu1, px1.

Figure 7A:
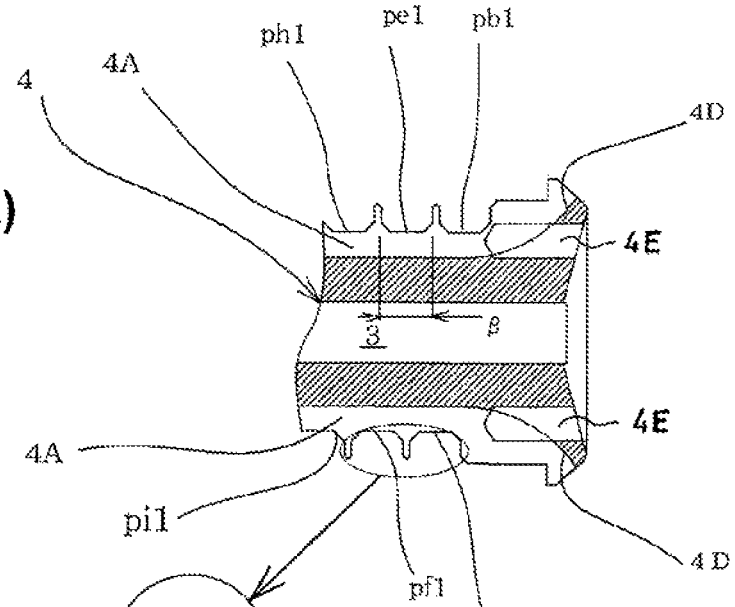
FIG. 7 shows an enlarged view of the inner cylinder shown in FIG. 6, FIG. 7(A) a partially sectional view of the inner cylinder, and FIG. 7(B) a plan view of an elongated accommodation hole on the inner cylinder.
Figure 7B:
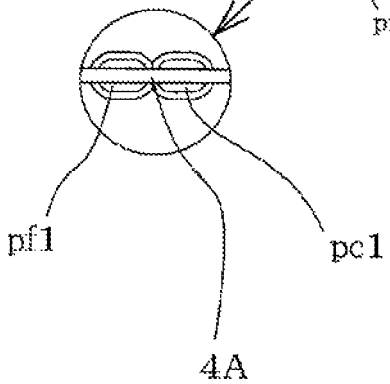

The accommodation holes pc1, pf1, pi1, pl1, po1, pr1, pu1, px1 are elongated or elliptical as shown in FIGS. 4, 6, 7. Diameter of the elongated elliptical accommodation holes is almost identical to or slightly larger than the ball-shaped auxiliary tumblers 7, and longitudinal length β is larger than diameters of the upper tumbler bores A1-X1 of the outer cylinder, so that the auxiliary tumblers 7 are allowed to be stably accommodated in the accommodation holes. The reason that the longitudinal length β of the elongated elliptical accommodation holes is set to be larger than diameters of the upper tumbler bores will be explained later.

Figure 8A:
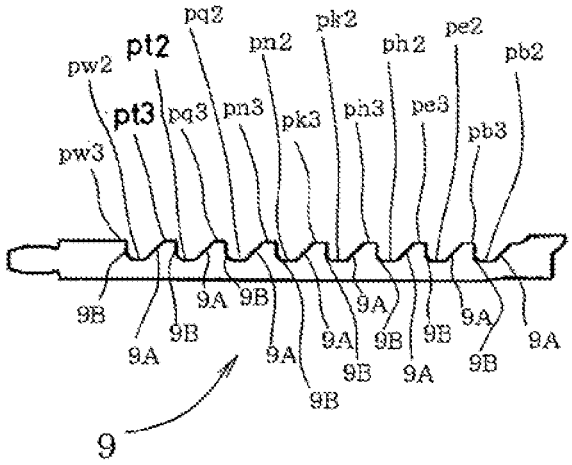
FIG. 8 shows a set/reset member, FIG. 8(A) a side view of the set/reset member provided with a root (pb2, pe2, ph2, pk2, pn2, pq2, pt2, pw2), and FIG. 8(B) a side view of the set/reset member provided with a root (pc2, pf2, pi2, pl2, po2, pr2, pu2, px2).
Figure 8B:
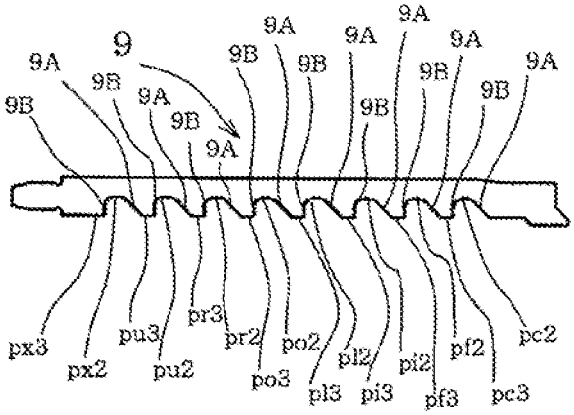

Further, as shown in FIGS. 4 and 8, a long set/reset member 9 is arranged fit into each groove 4A in a manner of being freely slidable. The set/reset member 9 is provided on the edge with crests (pb3, pc3, pe3, pf3, ph3, pi3, pk3, pl3, pn3, po3, pq3, pr3, pt3, pu3, pw3, px3) and roots (pb2, pc2, pe2, pf2, ph2, pi2, pk2, pl2, pn2, po2, pq2, pr2, pt2, pu2, pw2, px2) in a manner of alternately ranging. And tapered parts 9A are formed between the rear side of each root and each crest, and stopping parts 9B between the front side of each root and each crest.

Figure 11:
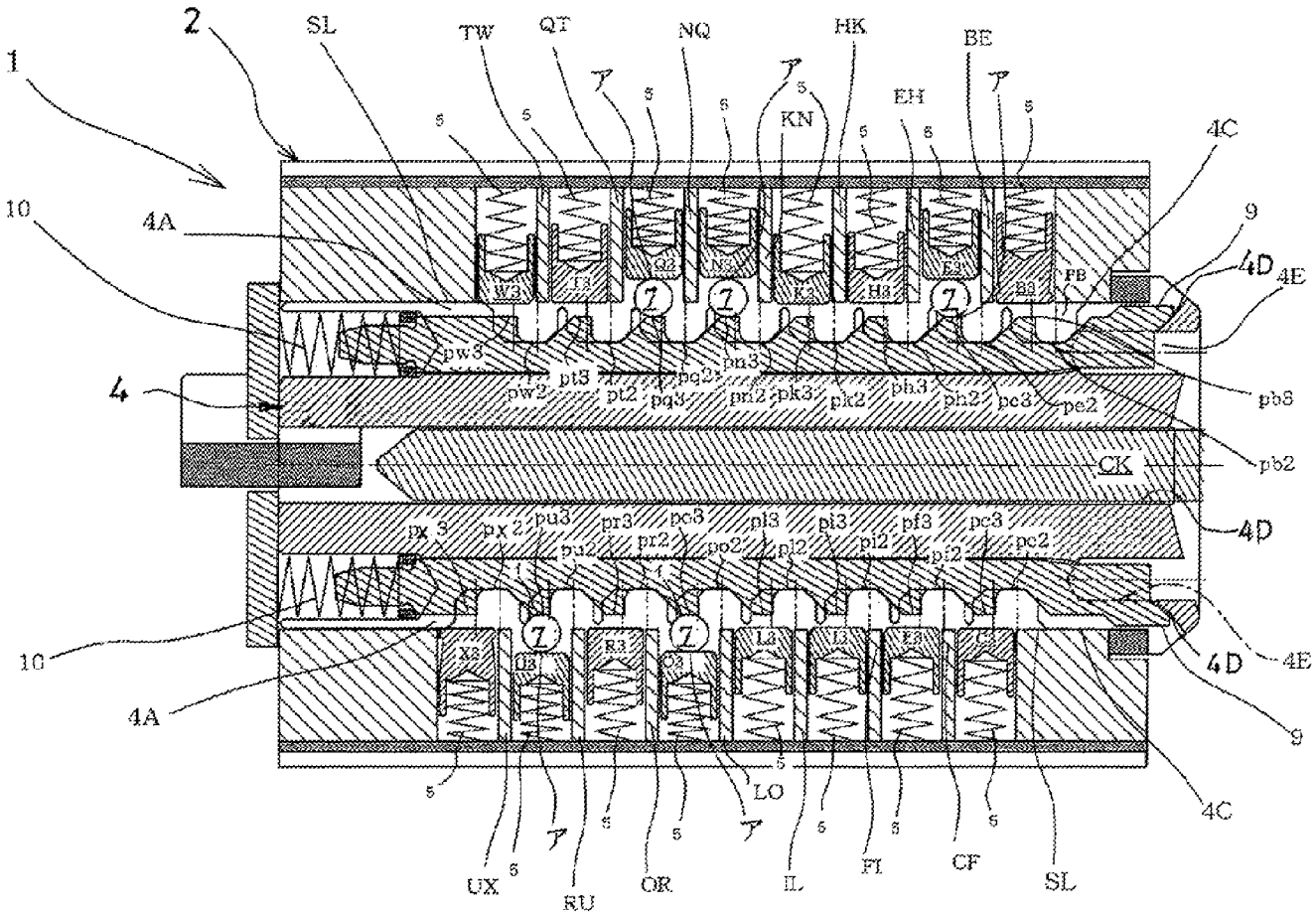
FIG. 11 is a sectional view taken in the line Z2-Z2 in FIG. 1 showing the situation that a key (a change key) is inserted into the keyway in the reset state and turned clockwise about 35 degrees.

The set/reset member 9 has a spring 10 (an urging member) interposed between the front end of the set/reset member 9 and the front side of the groove 4A. The set/reset member 9 is regularly urged backward (for example, rightward in FIG. 4), and the rear end of the set/reset member 9 hits and contacts with a brim 4D of the inner cylinder 4, so that the set/reset member 9 is prevented from further moving. In this regular situation, the crests (pb3, pc3, pe3, pf3, ph3, pi3, pk3, pl3, pn3, po3, pq3, pr3, pt3, pu3, pw3, px3) of the set/reset member 9 are positioned in a manner of preventing shifting of the auxiliary tumblers 7 in order to avoid that the auxiliary tumblers 7 placed in the upper tumbler bores (B1, C1, E1, F1, H1, I1, K1, L1, N1, O1, Q1, R1, T1, U1, W1, X1) are pushed and accommodated into the accommodation holes (pb1, pc1, pe1, pf1, ph1, pi1, pk1, pl1, pn1, po1, pq1, pr1, pt1, pu1, pw1, px1) with an urging force of the spring 5 when a key CK adaptable to the cylinder lock of the present invention is inserted into the keyway 3 of the inner cylinder 4, and the inner cylinder 4 is then turned to a position to cause the upper tumbler bores (B1, C1, E1, F1, H1, I1, K1, L1, N1, O1, Q1, R1, T1, U1, W1, X1) to face the accommodation holes (pb1, pc1, pe1, pf1, ph1, pi1, pk1, pl1, pn1, po1, pq1, pr1, pt1, pu1, pw1, px1) of the inner cylinder 4. FIG. 11 illustrates the situations (ア) that the auxiliary tumblers 7 hit and contact with the crests (pe3, pn3, po3, pq3, pu3).

In this state, the roots (pb2, pc2, pe2, pf2, ph2, pi2, pk2, pl2, pn2, po2, pq2, pr2, pt2, pu2, pw2, px2), and the stopping parts 9B of the set/reset member 9, and partition walls (BE, CF, EH, FI, HK, IL, KN, LO, NQ, OR, QT, RU, TW, UX) which separate the upper tumbler bores (B1, C1, E1, F1, H1, I1, K1, L1, N1, O1, Q1, R1, T1, U1, W1, X1) form accommodation pockets (PB, PC, PE, PF, PH, PI, PK, PL, PN, PO, PQ, PR, PT, PU, PW, PX) which can accommodate the auxiliary tumblers 7 moved from between the upper tumblers and the lower tumblers.

Also, the brim 4D of the inner cylinder 4 is provided, in addition to the groove 4A, with an insertion bore 4E for the setting control member and the resetting control member, the bore 4E connecting to the outside, so that the set/reset member 9 is able to be pushed, from the outside, at its rear end against the urging force of the spring 10. In detail, inserted into the insertion bores 4E for the setting control member and the resetting control member are push-out pins 22, 32 of a setting control member 20 serving as a first jig and a resetting control member 30 as a second jig, so that a reset state is made in which a change key CK is set to the cylinder lock 1 as an adaptable key, and a fresh key CK is able to be set as the adaptable key in the set state that a key CK has been set as the adaptable key.

(In the Reset State, a Specific Key CK is Subjected to the Setting Operation)

The above explanation is about the structure in the cylinder lock 1 in the reset state according to the present invention. Next, operation that the cylinder lock 1 in the reset state changes to the set state in which a specific key CK as an adaptable key can unlock the lock 1 will be detailed with referring to FIGS. 9 through 14.

Figure 9:
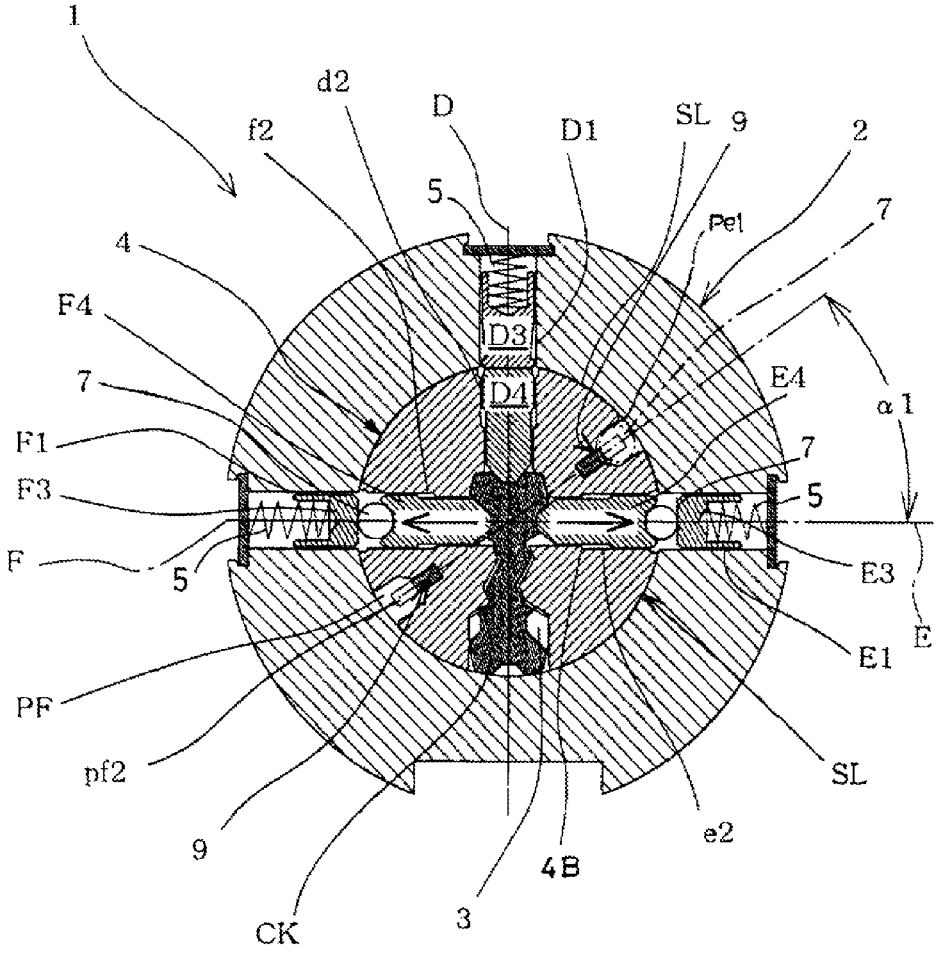
FIG. 9 is a sectional view taken in the lines D2-D2 and E-F in FIGS. 2 and 3 showing the situation that a key (a change key) is inserted into the keyway of the cylinder lock in the reset state in FIGS. 2, 3.

FIG. 9 is a sectional view taken from the lines D2-D2 and E-F in FIGS. 2 and 3 showing the state that a specific key CK is inserted into the cylinder lock 1 in the reset state. More minutely, when the specific key CK is inserted into the keyway 3 in the reset state shown in FIGS. 2 and 3, tip ends of the lower tumblers A4-X4 contact with serration and surface figuration on the upper end surface and left and right side surfaces of the key CK to move the lower tumblers A4-X4 upward corresponding to depth of the key's serration and surface figuration. A boundary plane between the lower tumblers A4-X4 and the upper tumblers A3-X3, or, that between the upper tumblers or the lower tumblers and the auxiliary tumblers 7 corresponds to a shear line SL with which the inner cylinder 4 is able to rotate with respect to the outer cylinder 2. As seen, the strokes of upward moving of the lower tumblers A4-X4 are limited by the depth of a plurality of dimples serving as serration and surface figuration formed on the upper end surface and both side surfaces of the key CK. In FIG. 9 which is the sectional view taken in the lines D2-D2 and E-F in FIGS. 2 and 3, the boundary between the upper tumbler D3 and the lower tumbler D4, that between the auxiliary tumbler 7 and the lower tumbler E4, and that between the upper tumbler F3 and the auxiliary tumbler 7 correspond to the shear line SL.

Figure 10:
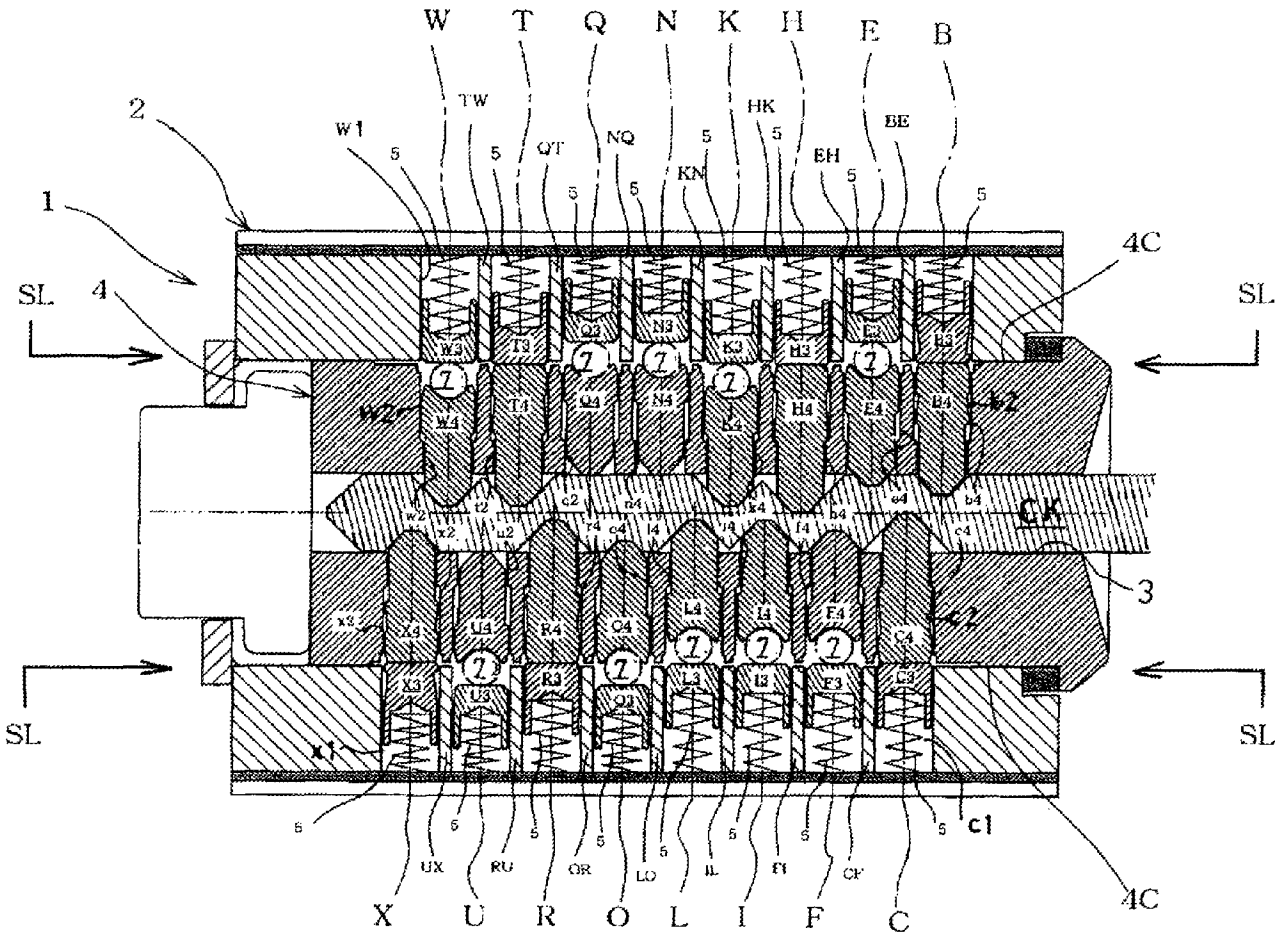
FIG. 10 is a sectional view taken in the line Z2-Z2 in FIG. 1 showing the situation that a key (a change key) is inserted into the keyway of the cylinder lock in the reset state in FIG. 1.

FIG. 10 is a sectional view taken in the line Z2-Z2 in FIG. 1 showing the situation that a key (a change key CK) is inserted into a keyway of the cylinder lock in the reset state. And FIG. 11 is a sectional view taken in the line Z2-Z2 in FIG. 1 showing the situation that a key CK is inserted into a keyway in the reset state as FIG. 10 and further operated to turn the inner cylinder 4 clockwise in angle of $\alpha 1$ (about 35 degrees).

The cylinder lock 1 in this Example is previously provided with a plural kinds of keys (change keys) CK having serration and surface figuration which comprises dimples or the like providing that when the key is inserted into the keyway 3, a boundary between the lower tumblers A4-X4 and the upper tumblers A3-X3, or, that between the upper tumblers A3-X3 or the lower tumblers A4-X4 and the auxiliary tumblers 7 corresponds to the shear line SL with which the inner cylinder 4 is able to rotate with respect to the outer cylinder 2. In case that one of the change keys CK is inserted into the keyway 3 of the cylinder lock 1 in the reset state in FIG. 3 to set the key as an adaptable key, for example, the five auxiliary tumblers 7 in the columns E, N, O, Q, and U as shown in FIG. 10 are moved to the side of the upper tumbler bores E1, N1, O1, Q1, U1 of the outer cylinder 2.

In the above situation, when the inner cylinder 4 is turned clockwise $\alpha 1$ (about 35 degrees) with respect to the outer cylinder 2 as shown in FIG. 9, the auxiliary tumblers 7 placed at the side of the upper tumbler bores E1, N1, O1, Q1, U1 face the elongated elliptical accommodation holes (pe1, pn1, po1, pq1, pu1) as shown in FIG. 11. But, the crests (pe3, pn3, po3, pq3, pu3) of the set/reset member 9 hit and contact (the situation "ア") with the auxiliary tumblers 7, thereby preventing the auxiliary tumblers 7 from being accommodated into the accommodation holes (pe1, pn1, po1, pq1, pu1) of the inner cylinder 4.

The auxiliary tumblers 7 placed at the side of the upper tumbler bores E1, N1, O1, Q1, U1 contact with the upper tumbler bores at the part (ア) in FIG. 11.

Longitudinal length $\beta$ of the accommodation holes (pb1, pc1, pe1, pf1, ph1, pi1, pk1, pl1, pn1, po1, pq1, pr1, pt1, pu1, pw1, px1) of the inner cylinder 4 is so set that an opening of each accommodation hole partially faces the upper tumbler bore (B1, C1, E1, F1, H1, I1, K1, L1, N1, O1, Q1, R1, T1, U1, W1, X1) and also a partition wall (BE, CF, EH, FI, HK, IL, KN, LO, NQ, OR, QT, RU, TW, UX) formed between adjoining upper tumbler bores on the outer cylinder 2.

Figure 12B:
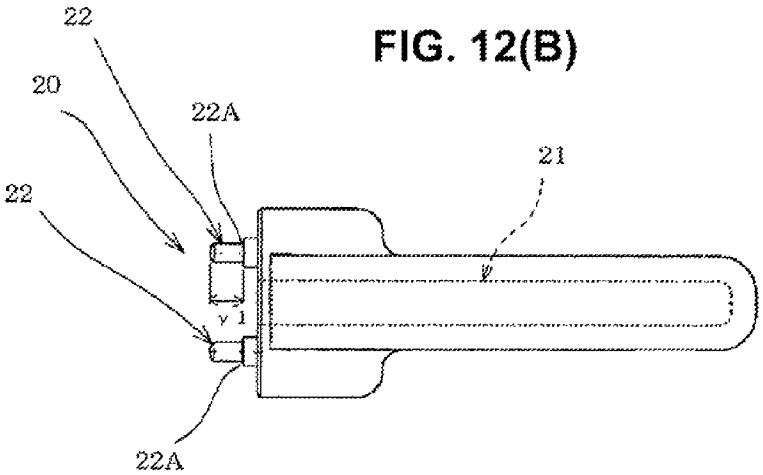
FIG. 12 shows a first jig, FIG. 12(A) a front sectional view, FIG. 12(B) a plan view, FIG. 12(C) a left side view and FIG. 12(D) a right side view.
Figure 12A:
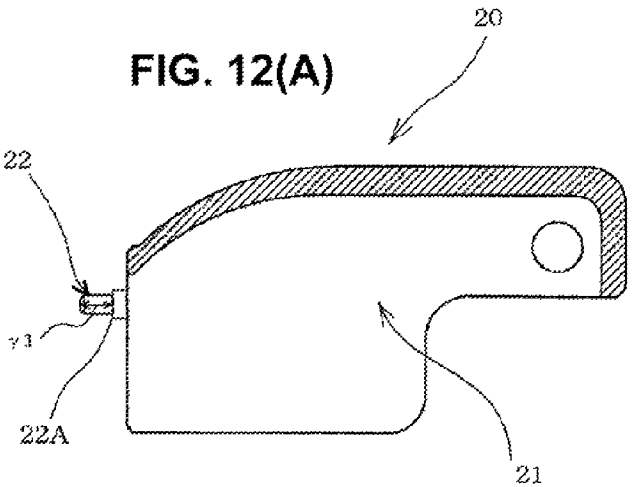
Figure 12D:
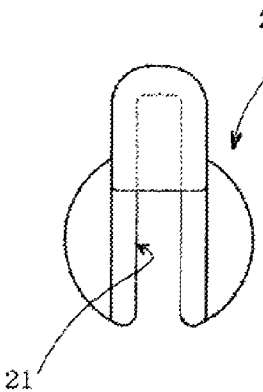
Figure 12C:
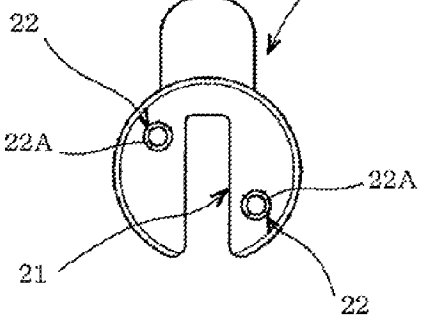

FIG. 12 shows a setting control member 20 serving as a first jig and provided with push-out pins 22 to be inserted into the set/reset pin insertion bores 4E formed integrally on the inner cylinder 4, FIG. 12(A) being a partially sectional front view, FIG. 12(B) a plan view, FIG. 12(C) a left side view and FIG. 12(D) a right side view. The setting control member 20 is provided with a slit 21 with which the setting control member 20 is fit to the grip of the key CK serving as an adaptable key, and with a pair of push-out pins 22 (a first pin) which formed on the setting control member 20 at a point where the push-out pins 22 can be inserted into the set/reset pin insertion bores 4E when the key CK is inserted into the keyway 3 with the grip of the key CK being fit through the slit 21. The push-out pin 22 has a root part larger in diameter than the set/reset pin bore 4E, a tip end part having such diameter that the tip end part is inserted into the set/reset pin bore, and a stepped part 22A formed between the root part and the tip end part.

Figure 13:
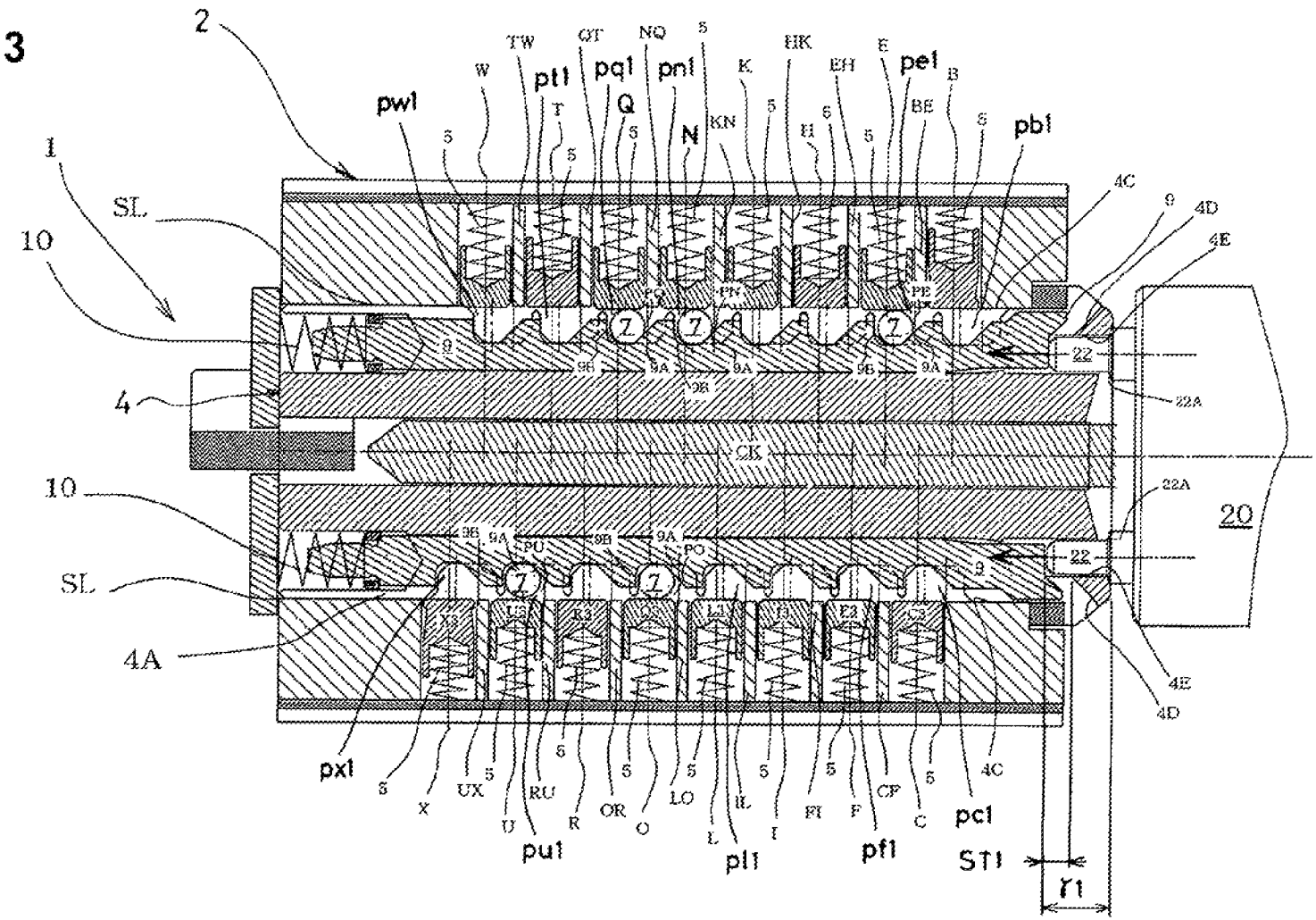
FIG. 13 is a sectional view taken in the line Z2-Z2 in FIG. 1 showing the situation that the set/reset member, in the situation in FIG. 11, is moved by a setting control member to drop the auxiliary tumbler into an accommodation pocket formed with the roots of the set/reset member and accommodation holes on the inner cylinder and accommodate them there.

And the setting control member 20 is fit, with the slit 21, to the grip of a key CK which subjected to the setting operation. The push-out pins 22 each having a first length γ1 are inserted into the set/reset pin insertion bore 4E of the inner cylinder 4 and completely pushed into the bore by the first length γ1 extending from the tip end to the stepped part. As seen in FIG. 13, the set/reset member 9 is pushed forward by stroke ST1, and contacting between the crests (pe3, pn3, po3, pq3, pu3) and the auxiliary tumblers 7 (see the reference "ア" in FIG. 11) is released, so that the auxiliary tumblers 7 placed at the upper tumbler bores (E1, N1, O1, Q1, U1) are pushed by an urging force of the spring 5 and automatically accommodated into the elongated elliptic accommodation holes (pe1, pn1, po1, pq1, pu1) on the inner cylinder 4 and the roots (pe2, pn2, po2, pq2, pu2) of the set/reset member 9.

In the situation that the auxiliary tumblers 7 contact with the crests (pe3, pn3, po3, pq3, pu3) of the set/reset member 9, the push-out pin 22 of the setting control member 20 having the first length γ1 is pushed into by the stroke ST1 and the auxiliary tumblers 7 are accommodated into the accommodation holes pe1, pn1, po1, pq1, pu1 as shown in FIG. 13.

Figure 14:
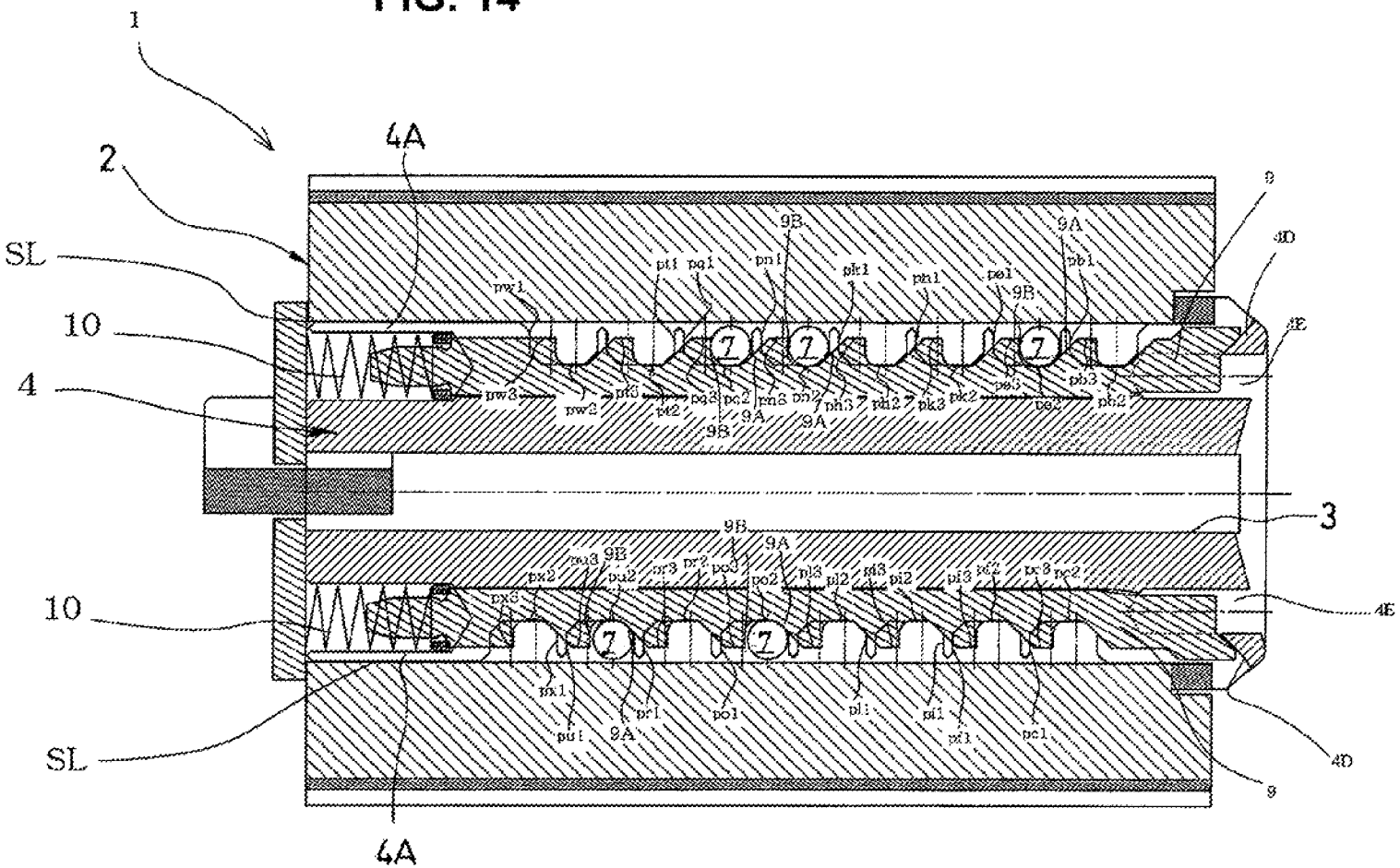
FIG. 14 is a sectional view taken in the line Z3-Z3 in FIG. 1 showing the situation that operation of the setting control member, in the situation in FIG. 13, is released, the set/reset member is returned to its initial previous situation thanks to a spring urging the set/reset member, and the key is turned counterclockwise in angle of $\alpha$1 (about 35 degrees).
Figure 15B:
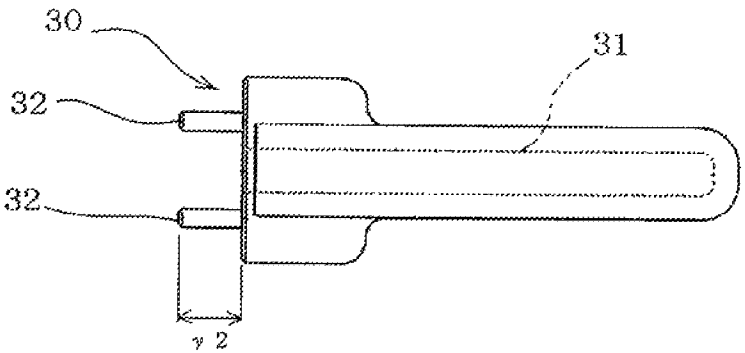
FIG. 15 shows a resetting control member as a second jig, FIG. 15(A) a front sectional view, FIG. 15(B) a plan view, FIG. 15(C) a left side view and FIG. 15(D) a right side view.
Figure 15A:
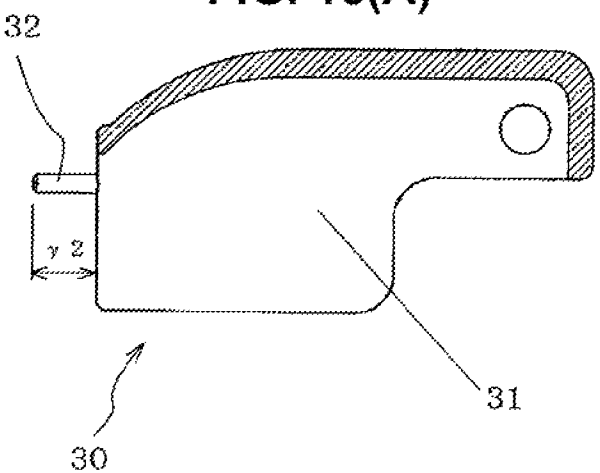
Figure 15C:
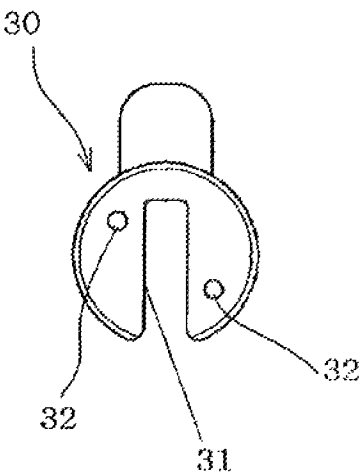
Figure 15D:
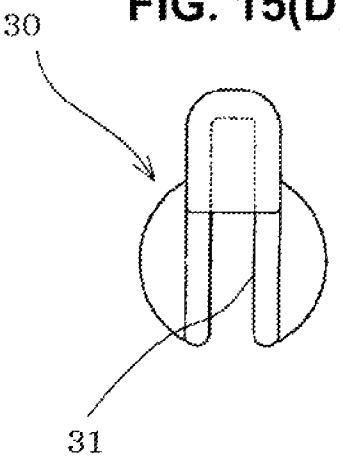

FIG. 14 shows the situation that the setting control member 20, in the state shown in FIG. 13, is turned counterclockwise at an angle of α1 while kept to be pushed into, and then the key CK with the setting control member 20 are pulled out.

When pushing operation for the setting control member 20 is released, the auxiliary tumblers 7 accommodated in the accommodation holes pe1, pn1, po1, pq1, pu1 are, pushed by the stopping part 9B of the set/reset member 9 to be pushed longitudinally in the elongated elliptical accommodation holes pe1, pn1, po1, pq1, pu1 each in length of β as shown in FIG. 7. Resultantly, the auxiliary tumblers 7, . . . , 7 in the accommodation holes pe1, pn1, po1, pq1, pu1 are moved to a position where they face the partition walls BE, BN, BO, BQ, BU, whereby the auxiliary tumblers 7 are held in this situation. This means that for the cylinder lock, the key CK has been set to be usable.

Figure 16:
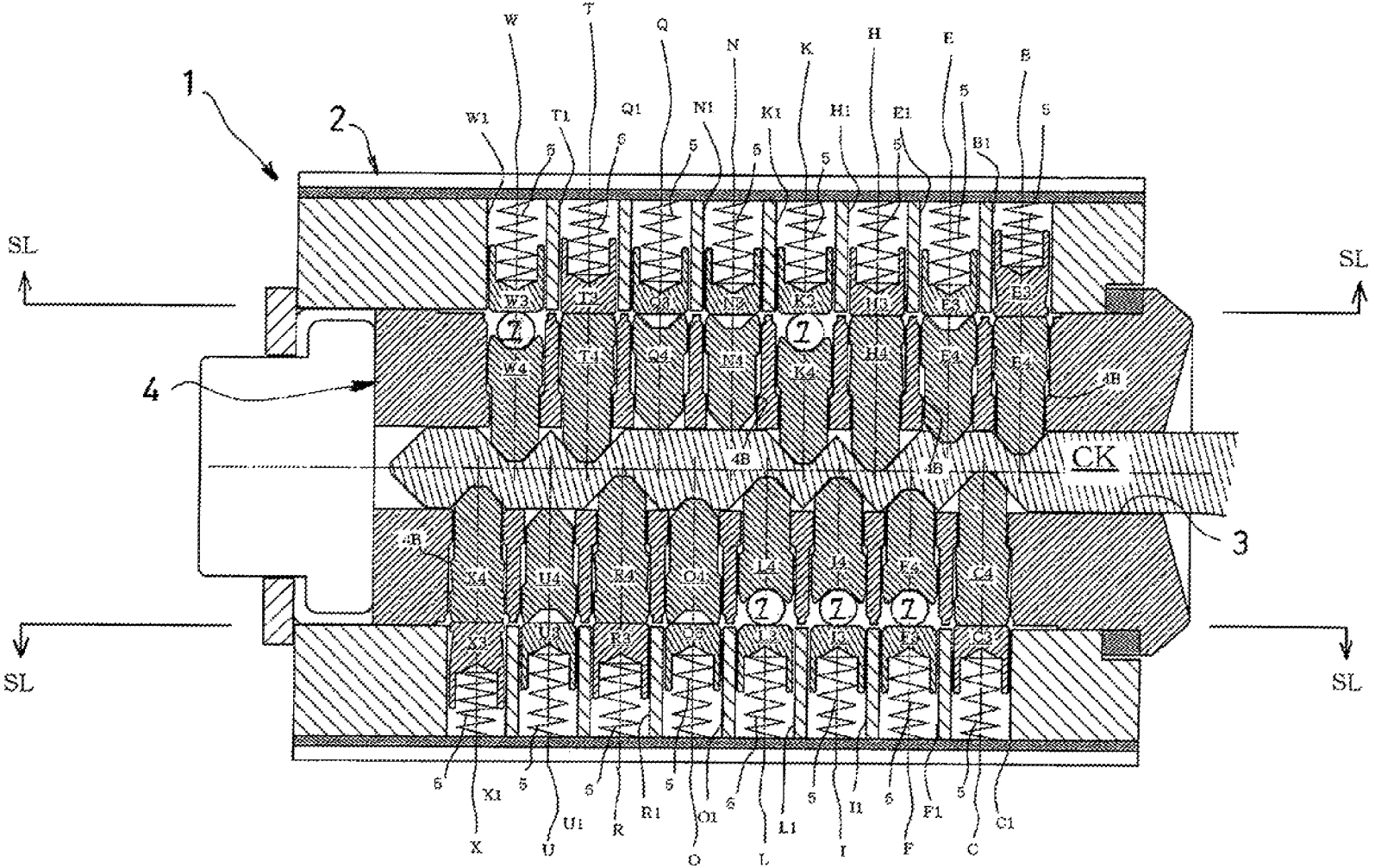
FIG. 16 is a sectional view taken in the line Z2-Z2 in FIG. 1 showing the situation that a key serving as an adaptable key (a change key) is inserted into the keyway of the cylinder lock in the set state.

In the set state with the key CK having been set to be usable, five auxiliary tumblers 7 are moved aside from between the upper tumblers A3-X3 and the lower tumblers A4-X4, and other five auxiliary tumblers 7 remain in the columns. Thus, only change keys having the serration and surface figuration corresponding to this cylinder lock 1 are able to lock and unlock the cylinder lock. Other change keys are not able to lock and unlock the cylinder lock. FIG. 16 shows the situation that the key CK is inserted into the cylinder lock 1 with the key CK having been set to be usable.

(Operation for Key-Change from the Key CK to Other Different Key CK' (not Shown))

Figure 17:
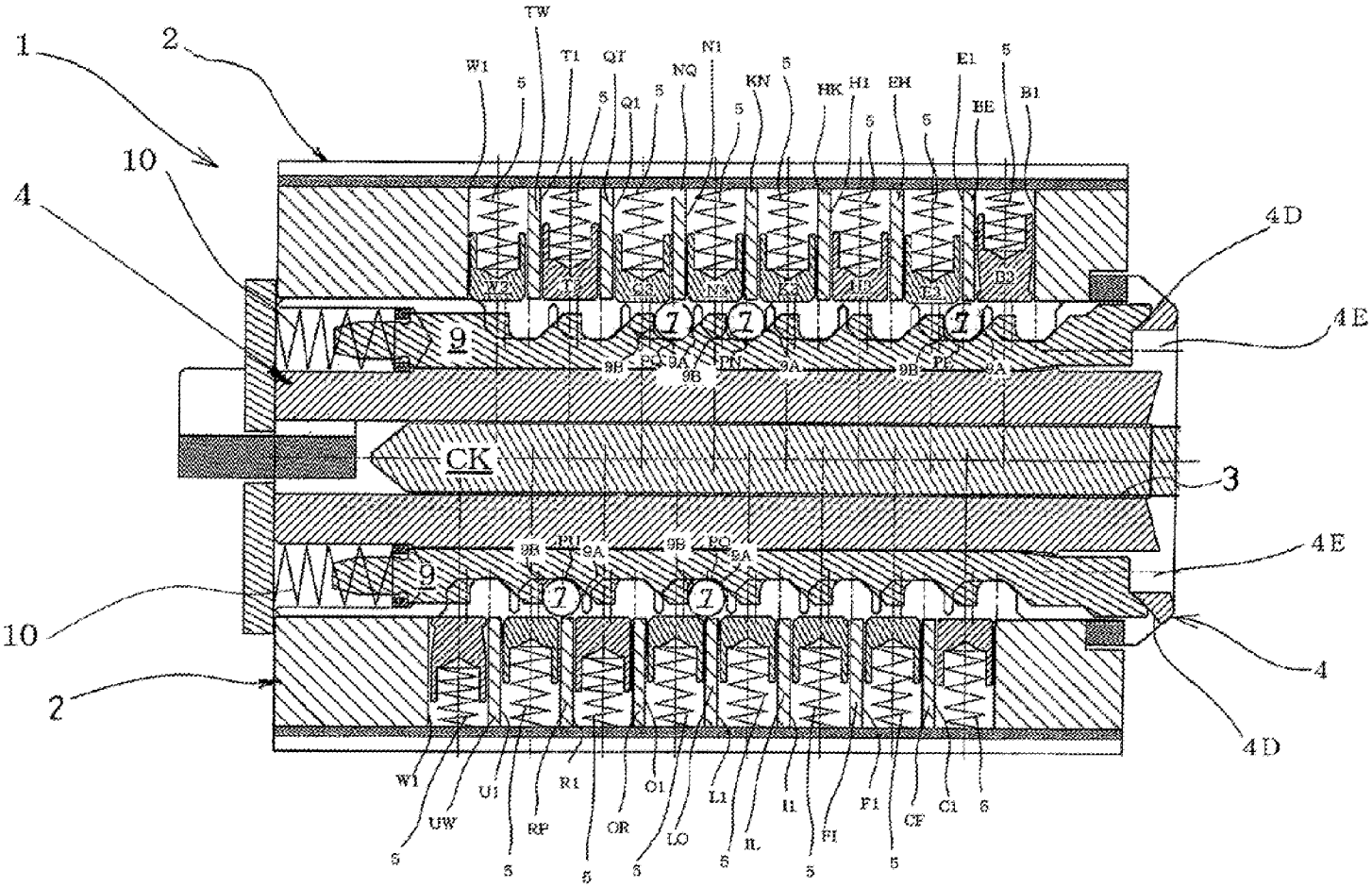
FIG. 17 is a sectional view taken in the line Z2-Z2 in FIG. 1 showing the case that a key (a change key), in the situation in FIG. 16, is turned clockwise in angle of $\alpha$1 (about 35 degrees).
Figure 18:
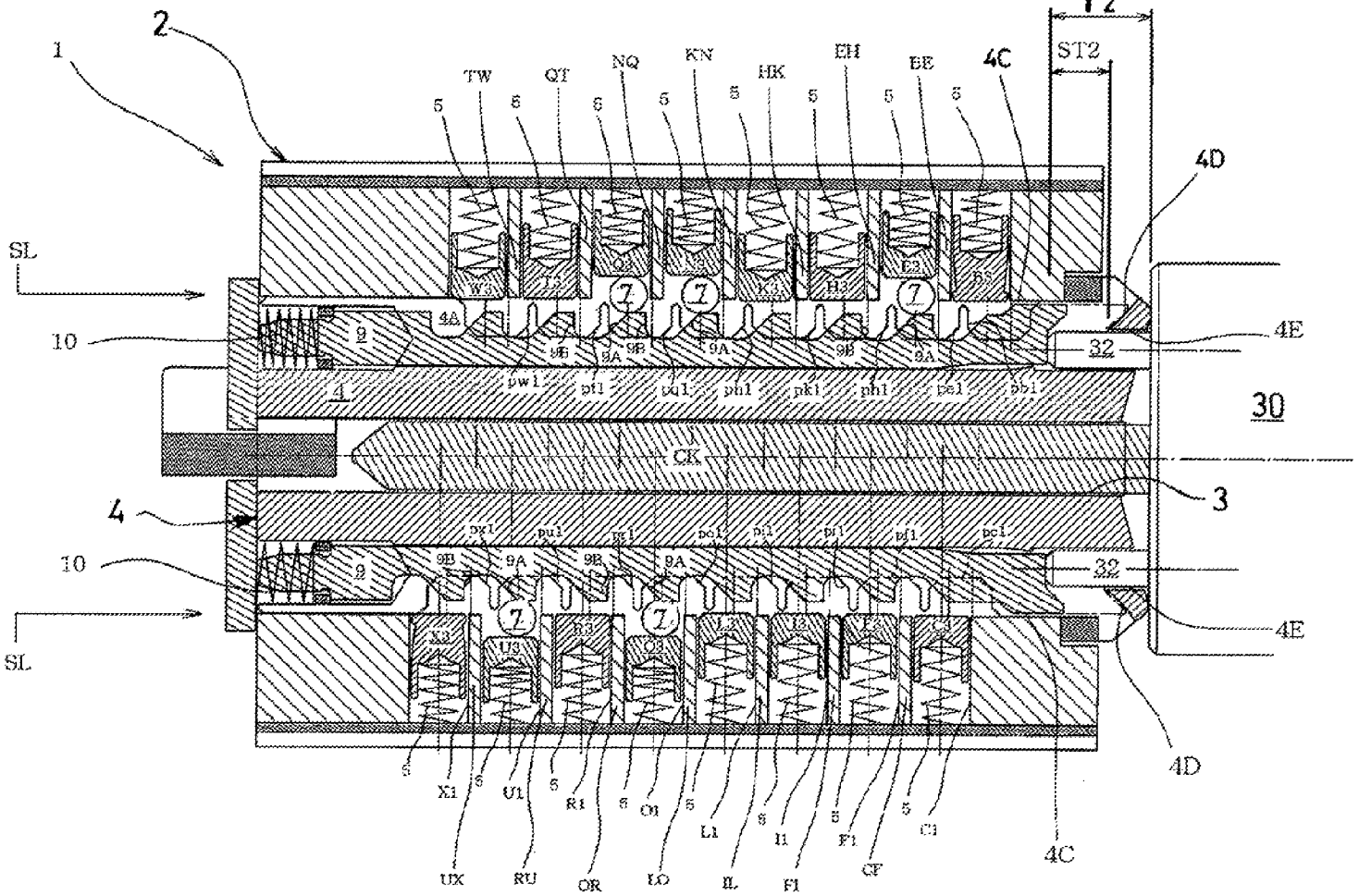
FIG. 18 is a sectional view taken in the line Z2-Z2 in FIG. 1 showing the situation that the set/reset member, in the situation in FIG. 17, is moved by the resetting control member, so that the auxiliary tumblers accommodated in the accommodation pockets are placed back into the upper tumbler bores on the outer cylinder.

Operation of key-change (to other different key CK' (not shown)) for a cylinder lock 1 which in the set state with a specific key CK having been set to be usable as an adaptable key will be detailed with referring to FIGS. 15 through 18. FIG. 15 shows a "resetting" control member 30 serving as a second jig, FIG. 15(A) being a partially sectional front view, FIG. 15(B) a plan view, FIG. 15(C) a left side view and FIG. 15(D) a right side view. FIG. 16 is a sectional view taken in the line Z2-Z2 in FIG. 1 showing the situation that a key CK serving as an adaptable key is inserted into the cylinder lock 1 in the set state with the key CK having been set to be usable. FIG. 17 is a sectional view taken in the line Z2-Z2 in FIG. 1 showing that the key (change key) CK is turned clockwise at an angle of α1 (about 35 degrees) in the situation in FIG. 16. FIG. 18 is a sectional view taken in the line Z2-Z2 in FIG. 1 showing the situation that the set/reset member 9 is pushed moved by the resetting control member 30, in the state in FIG. 17, to move back the auxiliary tumblers accommodated in the accommodation pockets into the upper tumbler bores in the outer cylinder 2.

The resetting control member 30 shown in FIG. 15 is provided integrally with push-out pins 32 which are to be inserted into the set/reset pin insertion bores 4E of the inner cylinder 4. The resetting control member 30 is provided with a slit 31 with which the resetting control member 30 is fit to the grip of the key CK serving as an adaptable key. The resetting control member 30 is inserted into the cylinder lock 1 with the grip of the key CK being fit through the slit 31.

And the push-out pins 32 of the resetting control member 30 each having a second length γ2 are inserted into the set/reset pin insertion bore 4E of the inner cylinder 4, to push the set/reset member 9 by the stroke ST2.

FIG. 18 shows the situation that, in the state shown in FIG. 17 wherein the key CK is turned at an angle of α1, the resetting control member 30 has been inserted into the set/reset pin insertion bores 4E and pushed into by the second length γ2. In this situation, the push-out pins 32 of the resetting control member 30 push the set/reset member 9 by the stroke ST2 which is longer than the pushing stroke ST1 in the setting operation (see FIG. 13). In this process, at the time when the set/reset member 9 is pushed by a stroke corresponding to the stroke ST1, the auxiliary tumblers 7 accommodated in the accommodation pockets PE, PN, PQ, PO, PU are moved to a position to face the upper tumbler bores E1, N1, Q1, O1, U1 on the outer cylinder 2 similarly to the case of pushing the set/reset member 9 by the stroke ST1 by the setting control member 20 shown in FIG. 13. And when the set/reset member 9 is further pushed by a remaining stroke completing the stroke ST2, as shown in FIG. 18, the auxiliary tumblers 7 hit and contact with the slant surface of the tapered part 9A of the set/reset member 9, whereby the auxiliary tumblers 7 accommodated in the accommodation pockets are pushed up, along the tapered part 9A, toward the upper tumbler bores E1, N1, Q1, O1, U1 and moved into the upper tumbler bores E1, N1, Q1, O1, U1 of the outer cylinder 2.

In this situation (FIG. 18), the key CK and the resetting control member 30 are turned to return the inner cylinder 4 to its initial position. The resetting control member 30 is then pulled out, thereby making the reset state shown in FIG. 10.

For changing the key CK being used presently to other fresh key CK' (not shown), the fresh key CK' (not shown) is first inserted into the cylinder lock 1 in the reset state similarly to the foregoing setting operation for the key CK and the key CK' is turned at an angle of α1. In this situation, the set/reset member 9 is pushed into by the stroke ST1 by the setting control member 20. (five auxiliary tumblers 7 placed at the side of the upper tumbler bores of the outer cylinder 2 fall into the accommodation bores on the inner cylinder 4.)

And in this situation, the key CK' is turned back at an angle of α1 and the setting control member 20 is pulled out, so that the cylinder lock 1 becomes to be in the set state with the fresh key CK' (not shown) having been set to be usable.

(Explanation of Operation with Master Key MK)

As above, explanation has been given on the operation that a key CK (which is previously provided for the cylinder lock 1 according to the present invention, is changeable, and corresponds to a specific change key) is set as an adaptable key by use of the setting control member 20, and also on the operation returning to an initial "reset state" by use of the resetting control member 30 for setting other fresh key CK' (not shown). The cylinder lock 1 according to the present invention provides such feature that plural cylinder locks 1 (each subjected to setting of respective different change key) are able to be locked and unlocked by means of one master key. Operation that the master key MK unlocks a cylinder lock 1 subjected to setting of one specific key CK will be explained with referring to FIGS. 3, 10, 16, 17 and 19.

FIG. 10 shows the situation that a key CK to be set is inserted into the keyway 3. According to the serration and surface figuration set for this specific key CK, a part of the auxiliary tumblers 7 interposed between the upper tumblers (E3, K3, N3, Q3, W3, F3, I3, L3, O3, U3) and the lower tumblers (E4, K4, N4, Q4, W4, F4, I4, L4, O4, U4), namely, five auxiliary tumblers 7 between the upper tumblers E3, N3, Q3, O3, U3 and the lower tumblers E4, N4, Q4, O4, U4 in the case shown in the drawing are pushed toward the upper tumbler bores E1, N1, Q1, O1, U1 of the outer cylinder 2, so that the boundary between the lower tumblers E4, N4, Q4, O4, U4 and the auxiliary tumblers 7 corresponds to the shear line SL, thereby enabling the inner cylinder to be rotated. And other five auxiliary tumblers 7 are placed at the side of the lower tumbler bores of the inner cylinder 4, and the boundary between the upper tumblers F3, I3, K3, L3, W3 and the auxiliary tumblers 7 corresponds to the shear line SL.

To be noted is that as foregoing, when the cylinder lock in the reset state is subjected to the setting of the key CK, as shown in FIGS. 10 and 16, five auxiliary tumblers are moved to the side of the upper tumbler bores of the outer cylinder and then held in the accommodation holes on the inner cylinder, and the remaining other five auxiliary tumblers are positioned at the side of the lower tumbler bores of the inner cylinder and are involved in the difference of keys for the cylinder lock.

There is so adapted that when other fresh key CK' (not shown) is set to be usable, five auxiliary tumblers 7 at the side of the lower tumbler bores of the inner cylinder are to be changed of specific columns (in which columns the auxiliary tumblers 7 are to be set and positioned), so that the cylinder lock is no longer able to be operated with the previously set key CK. In other words, the change of the columns that five auxiliary tumblers 7 on the inner cylinder are to be set and positioned creates the difference of usable keys.

Similarly, other keys CK each relate to different auxiliary tumblers 7 to be moved toward the upper tumbler bores. Thus, different keys CK are not usable for operating a specific cylinder lock due to applying of specific auxiliary tumblers 7 on different positions.

The serration and surface figuration of the master key MK is so set that the auxiliary tumblers 7 interposed between the upper tumblers (E3, K3, N3, Q3, W3, F3, I3, L3, O3, U3) and the lower tumblers (E4, K4, N4, Q4, W4, F4, I4, L4, O4, U4) are all pushed toward the upper tumbler bores E1, K1, N1, Q1, W1, F1, L1, O1, U1, so that even in case that whatever key CK has been set, and whatever upper and lower tumblers the auxiliary tumblers 7 remain between, when the master key MK is inserted into the keyway 3 of the cylinder lock 1 as set, five auxiliary tumblers remaining between the upper tumblers and the lower tumblers are moved to the side of the upper tumblers bores on the outer cylinder 2, and the boundary between the lower tumblers and the auxiliary tumblers corresponds to the shear line SL, thereby enabling all of the cylinder locks 1 to be locked and unlocked with one master key MK.

Figure 19:
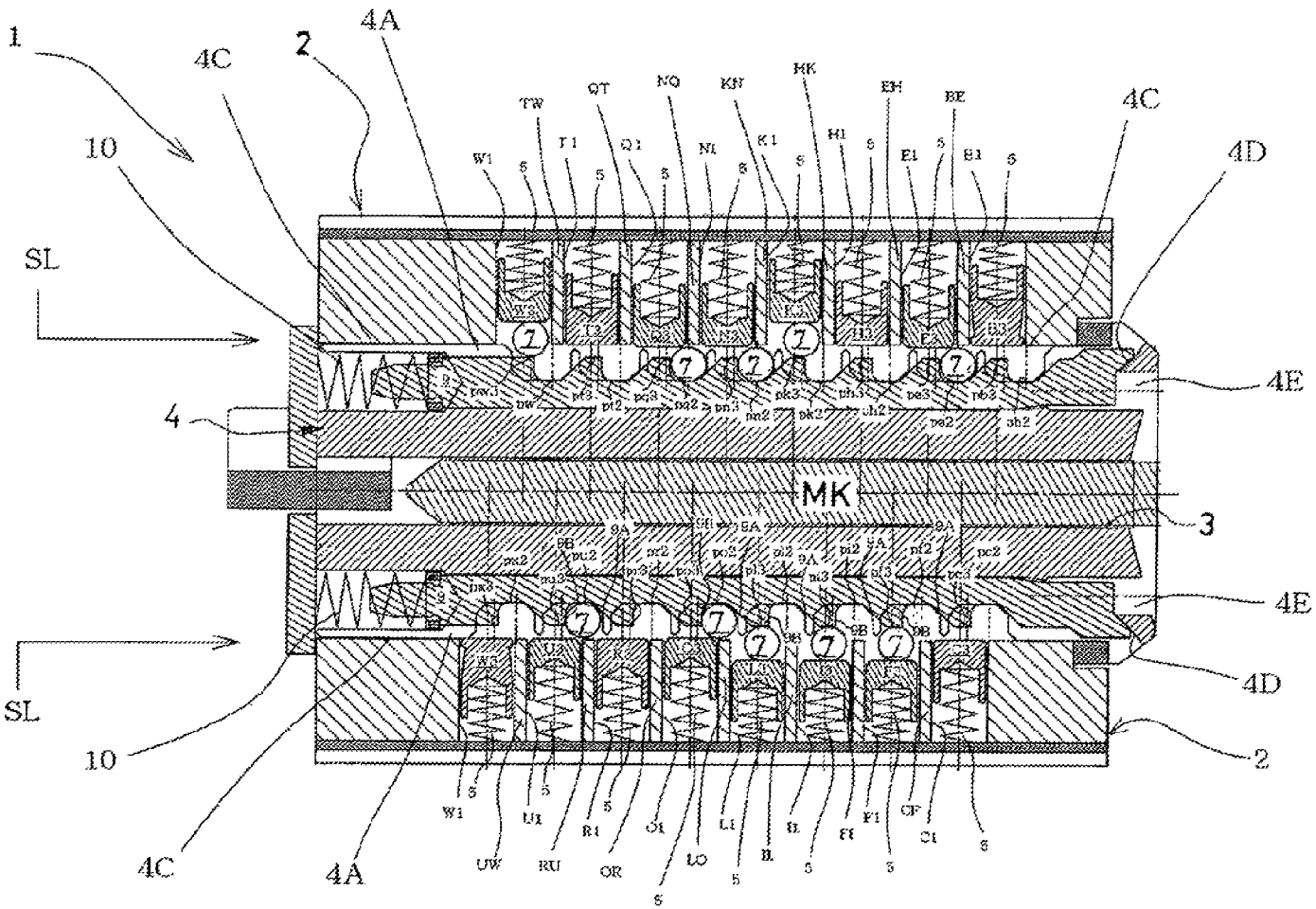
FIG. 19 is a sectional view taken in the line Z2-Z2 in FIG. 1 showing the case that a master key is inserted into a keyway of a cylinder lock with a key (a change key) having been set as an adaptable key to the cylinder lock, and the master key is turned clockwise in angle of $\alpha$1 (about 35 degrees).

In the cylinder lock 1 (shown in FIG. 16) set by a specific key CK, the auxiliary tumblers 7 remain between the upper tumblers K3, W3, F3, I3, L3 and the lower tumblers K4, W4, F4, I4, L4. When the master key is inserted into the cylinder lock 1 and turned, those five auxiliary tumblers 7 remaining in the lower tumbler bores of the inner cylinder are all moved toward and to the upper tumbler bores K1, W1, F1, I1, L1. The master key MK is, in this situation, turned clockwise in angle of $\alpha$1 together with the inner cylinder 4 as shown in FIG. 19.

As seen, the master key MK has such advantages that a group of a plurality of cylinder locks 1 set with plural different keys CK can be locked and unlocked by use of one master key MK, and also that, as a feature of use, in case that the cylinder lock 1 is used for collective residences or dwellings, such as an apartment house, following change of residents of apartments, the key can be changed to any other fresh key CK, and making the key CK previously used not usable. Even in case that a resident loses the key CK for his/her apartment, the master key MK is usable for locking and unlocking as shown in FIG. 19. Besides, in the situation in FIG. 19, the resetting control member 30 may be used for making the reset operation, so that all of the auxiliary tumblers 7 are returned to the upper tumbler bores side, thereby having the reset state.

Also, a "shut-out state" that the cylinder lock can be locked and unlocked only with the master key MK but can not with any other keys CK is provided, in the situation in FIG. 10, by using the setting control member 20 to cause all of the auxiliary tumblers 7 to be accommodated into the accommodation pockets side.

INDUSTRIAL APPLICABILITY

The present invention is applicable as a cylinder lock which can use change keys and a master key being capable of locking and unlocking a plurality of cylinder locks, the change keys being able to make or be subjected to key-change repeatedly.

EXPLANATION OF REFERENCES

1 a cylinder lock
2 an outer cylinder
3 a keyway
4 an inner cylinder
4A a groove
4B a stepped part
4C the outer peripheral surface
4E a set/reset pin insertion bore
5 a spring
7 an auxiliary tumbler
9 a set/reset member
9A a tapered part
9B a stopping part
20 a setting control member (a first jig)
22 a push-out pin
22A a stepped part
30 a resetting control member (a second jig)
32 a push-out pin
A1-X1 upper tumbler bores
a2-x2 lower tumbler bores
A3-X3 upper tumblers
A4-X4 lower tumblers
PB, PC, PE, PF, PI, PK, PL, PN, PO, PQ, PR, PT, PU, PW, PX accommodation pockets
pb1, pc1, pe1, pf1, ph1, pi1, pk1, pl1, pn1, po1, pq1, pr1, pt1, pu1, pw1, px1 elongated elliptical accommodation holes pb2, pc2, pe2, pf2, ph2, pi2, pk2, pl2, pn2, po2, pq2, pr2, pt2, pu2, pw2, px2 roots pb3, pc3, pe3, pf3, ph3, pi3, pk3, pl3, pn3, po3, pq3, pr3, pt3, pu3, pw3, px3 crests BE, CF, EH, FI, HK, IL, KN, LO, NQ, OR, QT, RU, TW, UX partition walls CK a key (a change key)

MK a master key

SL shear line

What is claimed is:

1. A cylinder lock comprising:

an outer cylinder longitudinally having a plurality of upper tumbler bores;

an inner cylinder which is fit into the outer cylinder so as to be freely rotatable, the inner cylinder having a plurality of lower tumbler bores connecting with a keyway and corresponding to the plural upper tumbler bores in the outer cylinder;

upper tumblers inserted into the upper tumbler bores of the outer cylinder, respectively;

springs arranged in the upper tumbler bores, respectively, so as to urge the upper tumblers toward the inner cylinder;

lower tumblers inserted into the lower tumbler bores of the inner cylinder, respectively; and auxiliary tumblers interposed between the upper tumblers and the lower tumblers of spontaneously selected pairs of upper tumblers and lower tumblers, so that the auxiliary tumblers can be moved aside from between the upper tumblers and the lower tumblers, thereby enabling a change of keys for locking and unlocking the cylinder lock, wherein a plurality of elongated accommodation holes are formed longitudinally on an outer peripheral surface of the inner cylinder, and a groove is formed on the outer peripheral surface of the inner cylinder so as to connect the plural accommodation holes, wherein partition walls are provided for separating adjacent ones of the upper tumbler bores from each other, wherein the elongated accommodation holes are each formed in such region that when the inner cylinder is turned at a predetermined angle to cause the elongated accommodation holes to be positioned facing the upper tumbler bores, a longitudinal length of each accommodation hole extends from a corresponding upper tumbler bore facing the accommodation hole to a partition wall adjoining to the corresponding upper tumbler bore, wherein a set/reset member is arranged to slide freely in the groove, the set/reset member being provided with crests and roots formed alternately continuously to each other in a longitudinal direction, a tapered part being provided behind each root and in front of each crest, and a stopping part being provided in front of each root and behind each crest, such that in a reset state in which all of the auxiliary tumblers are positioned between the upper tumblers and the lower tumblers, upon insertion of an adaptable key into the keyway of the inner cylinder so as to move any ones of the auxiliary tumblers into the upper tumbler bores and the remaining auxiliary tumblers into the lower tumbler bores, the inner cylinder is configured to be turned at a predetermined angle so as to bring the auxiliary tumblers positioned in the upper tumbler bores into contact with crests of the set/reset member, and the set/reset member is configured to be pushed by a first stroke longitudinally of the groove, through an outside operation, so as to move the auxiliary tumblers contacting with the crests to a position of facing the roots whereby the auxiliary tumblers are accommodated into accommodation holes on the inner cylinder by an urging force of the springs for the upper tumblers, such that upon releasing the set/reset member, the stopping parts of the set/reset member move the auxiliary tumblers accommodated in the accommodation holes longitudinally of the elongated accommodation holes by an urging force of a spring for the set/reset member to a position such that each of the auxiliary tumblers in the accommodation holes faces a foregoing partition wall of a corresponding upper tumbler bore and is held in a set state, and in the set state, upon insertion of an adaptable key into the keyway of the inner cylinder, the inner cylinder is configured to be turned at a predetermined angle such that the accommodation holes face the upper tumbler bores, and the set/reset member is configured to be pushed, through an outside operation, by a second stroke longer than the first stroke such that the auxiliary tumblers held in the accommodation holes and positioned at roots of the elongated accommodation holes are pushed toward a side of the upper tumbler bores through function of the tapered parts in continuation to the roots, and such that crests in continuation to the tapered parts hold the auxiliary tumblers in the upper tumbler bores, the inner cylinder being further configured to be turned to a position at which the upper tumbler bores and the lower tumbler bores face each other, such that upon releasing the set/reset member, the auxiliary tumblers are returned to the reset state between the upper tumblers and the lower tumblers.

2. A cylinder lock as set forth in claim 1, further comprising:

an insertion bore for a set/reset pin, the insertion bore being provided at a front of the inner cylinder;

a first jig which holds a key which is to be inserted into the keyway for a setting operation, so that when the key is inserted into the keyway, a first pin having a first length is inserted into the set/reset pin insertion bore, and when the first pin having the first length is pushed in completely by the first stroke, the set/reset member is operated, through the outside operation, so as to change a position of the set/reset member from a position at which the crests face the upper tumbler bores to a position at which the roots face the upper tumbler bores; and a second jig which holds a key which is to be inserted into the keyway for a resetting operation, so that when the key is inserted into the keyway, a second pin having a second length longer than the first length is inserted into the set/reset pin insertion bore, and when the second pin having the second length is pushed in completely by the second stroke, the auxiliary tumblers positioned at roots of the elongated accommodation holes of the inner cylinder are pushed to the side of the upper tumbler bores by function of the tapered parts in continuation to the roots.

* * * * *